US011338214B2

(12) United States Patent
White et al.

(10) Patent No.: US 11,338,214 B2
(45) Date of Patent: May 24, 2022

(54) DARK RIDE TOWER SYSTEMS HAVING STATIONARY AND ADAPTABLE ROOMS

(71) Applicant: Universal City Studios LLC, Universal, CA (US)

(72) Inventors: Nathanael G. White, Orlando, FL (US); Kevin B. Primm, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 17/239,105

(22) Filed: Apr. 23, 2021

(65) Prior Publication Data

US 2021/0331082 A1 Oct. 28, 2021

Related U.S. Application Data

(60) Provisional application No. 63/016,019, filed on Apr. 27, 2020.

(51) Int. Cl.

| | |
|---|---|
| ***A63G 31/02*** | (2006.01) |
| ***A63G 31/16*** | (2006.01) |
| *A63G 31/00* | (2006.01) |

(52) U.S. Cl.

CPC ..... *A63G 31/02* (2013.01); *A63G 31/16* (2013.01); *A63G 2031/002* (2013.01)

(58) Field of Classification Search

CPC ..... A63G 1/24; A63G 25/00; A63G 31/00; A63G 31/02; A63G 31/04; A63G 31/08; A63G 31/16

USPC ..... 472/2, 59–61, 130; 434/55

See application file for complete search history.

(56) References Cited

U.S. PATENT DOCUMENTS

| | | | |
|---|---|---|---|
| 8,057,317 | B2 | 11/2011 | Roodenburg et al. |
| 8,225,555 | B2 | 7/2012 | Magpuri |
| 9,149,728 | B2 | 10/2015 | Beyr |
| 9,463,391 | B2 | 10/2016 | Job et al. |
| 10,086,300 | B1 * | 10/2018 | Suttell ..... G06T 19/003 |
| 10,463,981 | B1 | 11/2019 | Brister et al. |

(Continued)

FOREIGN PATENT DOCUMENTS

WO 2019017759 A1 1/2019

OTHER PUBLICATIONS

PCT/US2021/029154 International Search Report and Written Opinion dated Sep. 3, 2021.

*Primary Examiner* — Kien T Nguyen
(74) *Attorney, Agent, or Firm* — Fletcher Yoder P.C.

(57) ABSTRACT

A dark ride tower system includes a tower having first and second levels. The first level includes a stationary room having stationary walls and the second level includes an adaptable room having adaptable walls configured to be rearranged into a plurality of physical configurations. The dark ride tower system also includes a lift system configured to alternatingly move a ride vehicle between the first and second levels. In addition, the dark ride tower system includes a first projection system configured to generate projection mapping on the stationary walls to simulate movement of the ride vehicle relative to the stationary room while the ride vehicle is disposed within the stationary room. The dark ride tower system also includes a second projection system configured to generate projection mapping on the adaptable walls to present a show scene while the ride vehicle is disposed within the adaptable room.

20 Claims, 20 Drawing Sheets

(56) References Cited

U.S. PATENT DOCUMENTS

| | | | | |
|---|---|---|---|---|
| 10,632,390 | B1 | 4/2020 | Blum et al. | |
| 11,020,677 | B2 * | 6/2021 | Blum | A63G 31/02 |
| 2011/0203190 | A1 * | 8/2011 | Magpuri | A63J 25/00 52/10 |
| 2015/0224411 | A1 * | 8/2015 | Valtiner-Zuegg | G09B 9/00 472/60 |
| 2019/0232177 | A1 | 8/2019 | Hall et al. | |
| 2019/0344186 | A1 * | 11/2019 | Hall | A63G 1/10 |
| 2019/0351342 | A1 | 11/2019 | Hall et al. | |
| 2020/0254352 | A1 | 8/2020 | Blum et al. | |

* cited by examiner

DARK RIDE TOWER SYSTEMS HAVING STATIONARY AND ADAPTABLE ROOMS

CROSS-REFERENCE TO RELATED APPLICATION

This application claims priority to and the benefit of U.S. Provisional Application No. 63/016,019, entitled "Dark Ride Tower Systems Having Stationary and Adaptable Rooms," filed Apr. 27, 2020, which is hereby incorporated by reference in its entirety for all purposes.

BACKGROUND

The present disclosure relates generally to the field of amusement park rides. More specifically, embodiments of the present disclosure relate to dark ride tower systems configured to transition ride vehicles between stationary and adaptable rooms.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks include a variety of features providing unique experiences to each park guest. Some features may include a ride vehicle that may travel along a specific path. The path may include elements such that as the ride vehicle travels along the path, those elements may enhance a guest's experience. For example, the ride vehicle may enter and exit several rooms when traveling along the path, where there are elements inside of each room to enhance a guest's experience. However, it is now recognized that the ability to simulate more complex viewing experiences in a relatively compact space may further enhance guest experiences.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a dark ride tower system for an amusement park includes a tower having first and second levels. The first level includes a stationary room having stationary walls and the second level includes an adaptable room having adaptable walls configured to be rearranged into a plurality of physical configurations. The dark ride tower system also includes a ride vehicle configured to carry one or more guests of the amusement park. The dark ride tower system further includes a lift system configured to alternatingly move the ride vehicle between the first and second levels. In addition, the dark ride tower system includes a first projection system configured to generate projection mapping on the stationary walls to simulate movement of the ride vehicle relative to the stationary room while the ride vehicle is disposed within the stationary room. The dark ride tower system also includes a second projection system configured to generate projection mapping on the adaptable walls to present a show scene while the ride vehicle is disposed within the adaptable room. The dark ride tower system further includes a controller configured to synchronize movement of the ride vehicle caused by the lift system, rearrangement of the adaptable walls, and generation of the projection mapping on the stationary and adaptable walls via the first and second projection systems.

In addition, in certain embodiments, a method includes using a lift system to alternatingly move a ride vehicle between a first level that includes a stationary room having stationary walls and a second level that includes an adaptable room having adaptable walls configured to be rearranged into a plurality of physical configurations. The method also includes generating projection mapping, via a first projection system, on the stationary walls to simulate movement of the ride vehicle relative to the stationary room while the ride vehicle is disposed within the stationary room. The method further includes actuating the adaptable walls to rearrange from a first physical configuration to a second physical configuration while the ride vehicle is disposed within the stationary room. The method also includes generating projection mapping, via a second projection system, on the adaptable walls to present a show scene while the ride vehicle is disposed within the adaptable room.

In addition, in certain embodiments, a dark ride system for an amusement park, includes a stationary room having stationary walls and an adaptable room having adaptable walls configured to be rearranged into a plurality of physical configurations. The dark ride system also includes a ride vehicle configured to carry one or more guests of the amusement park. The dark ride system further includes a lift system configured to alternatingly move the ride vehicle between the stationary and adaptable room. The dark ride system also includes a first projection system configured to generate projection mapping on the stationary walls to simulate movement of the ride vehicle relative to the stationary room while the ride vehicle is disposed within the stationary room. The dark ride system further includes a second projection system configured to generate projection mapping on the adaptable walls to present a show scene while the ride vehicle is disposed within the adaptable room. The dark ride system also includes a controller configured to synchronize movement of the ride vehicle caused by the lift system, rearrangement of the adaptable walls, and generation of the projection mapping on the stationary and adaptable walls via the first and second projection systems.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
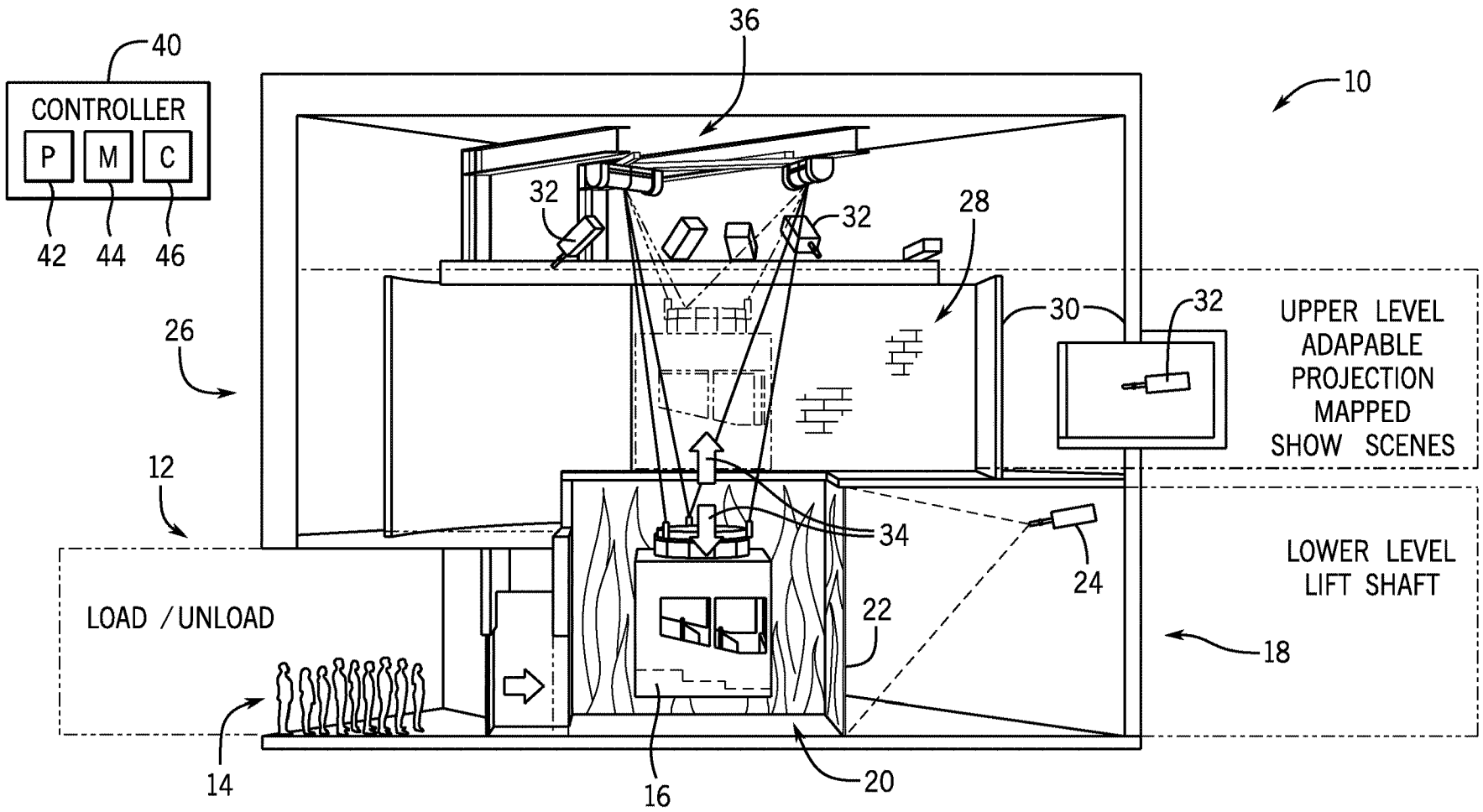
FIG. 1 is a side view of an embodiment of a dark ride tower system that may be located in an amusement park, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to dark ride tower systems that use a lift system to transition a ride vehicle back and forth between a stationary room configured to simulate movement of the ride vehicle via images projected on stationary walls of the stationary room and an adaptable room configured to simulate various scenes via images projected on adaptable walls of the adaptable room. As such, the embodiments described herein provide a complete dark ride experience in a relatively small footprint and without the need to horizontally move through show scenes, thereby eliminating the need for a track or other means of transportation for the ride vehicle.

The ride vehicle, whether suspended or ground lifted, travels vertically in a show scene space. One advantage of not moving linearly through space is that show scenes may be longer than conventional show scenes that, for example, utilize tracks to transport the ride vehicle. In certain embodiments, high speed movement and scene transitions may be simulated in a lower tower section (i.e., stationary room) via rear-projected screens (e.g., either two-dimensional or three-dimensional). The ride vehicle may then be lifted to the upper level(s) (i.e., having adaptable room(s)), which contain physical and projected show scenes. For example, the ride vehicle may ascend and rotate to align with different show scenes presented in the adaptable room(s). In certain embodiments, while the ride vehicle is disposed within the lower projected transition scenes (i.e., the stationary room), the upper sets (i.e., of the adaptable room(s)) may be reconfigured via sliding panels and show doors. As described in greater detail herein, the show sets (i.e., of the adaptable room(s)) may be moved into a variety of physical configurations, from relatively small spaces to relatively large immersive scenes. Projection mapping allows for the same show scene to be used multiple times representing different simulated locations. In certain embodiments, additional physical scene elements may be presented (i.e., in the adaptable room(s)). For example, in certain embodiments, these additional physical scene elements may include, but are not limited to, animated figures, special effects such as smoke, actors/actresses, and so forth.

In addition, in certain embodiments, the ride vehicle may move in multiple degrees of freedom to provide certain sensations that would not otherwise be possible (or would be significantly diminished) by a tower system with only one degree of freedom (e.g., with only vertical movement). Furthermore, the dark ride tower system described herein may permit a greater number of possible paths for the ride vehicle to take, thereby creating the possibility of providing a different experience for each guest. Indeed, the dark ride tower system described herein may enable the presentation of near limitless combinations of show scenes and simulated movement between these show scenes.

As such, the dark ride tower system described herein may be used to enhance a guest's experience in a number of different ways. For example, the ride vehicle may move in numerous degrees of freedom, such as rotational and translational movement, that may generate sensations felt by guests riding in the ride vehicle. Furthermore, the ride vehicle may enter and exit the rooms of the dark ride tower system in various ways, and may experience various show scenes within these rooms. The combination of movement by the ride system and the shows presented in each room, again, create a near limitless variety of guest experiences. Components and operations of the dark ride tower system will be further discussed below.

Turning to the drawings, FIG. 1 is a side view of an embodiment of a dark ride tower system 10 that may be located in an amusement park. As illustrated in FIG. 1, the dark ride tower system 10 includes a load/unload zone 12 where guests 14 may be queued to load onto a ride vehicle 16 and to embark from the ride vehicle 16 after a ride cycle has completed. In addition, the dark ride tower system 10 also includes a lower level 18 (i.e., lift shaft) that includes a stationary room 20 having a plurality of stationary walls 22 that surround the ride vehicle 16 when the ride vehicle 16 is disposed within the stationary room 20, as described in greater detail herein. In addition, the lower level 18 also includes a plurality of lower level projectors 24 (i.e., a lower level projection system) configured to project images on the stationary walls 22 of the stationary room 20 to simulate movement of the ride vehicle 16 disposed within the stationary room, as described in greater detail herein. In addition, the dark ride tower system 10 also includes an upper level 26 that includes one or more adaptable rooms 28 having a plurality of adaptable walls 30 configured to be adapted (e.g., rearranged) between projection mapped show scenes projected onto the adapted walls 30 via a plurality of upper level projectors 32 (i.e., an upper level projection system), as described in greater detail herein.

Figure 2:
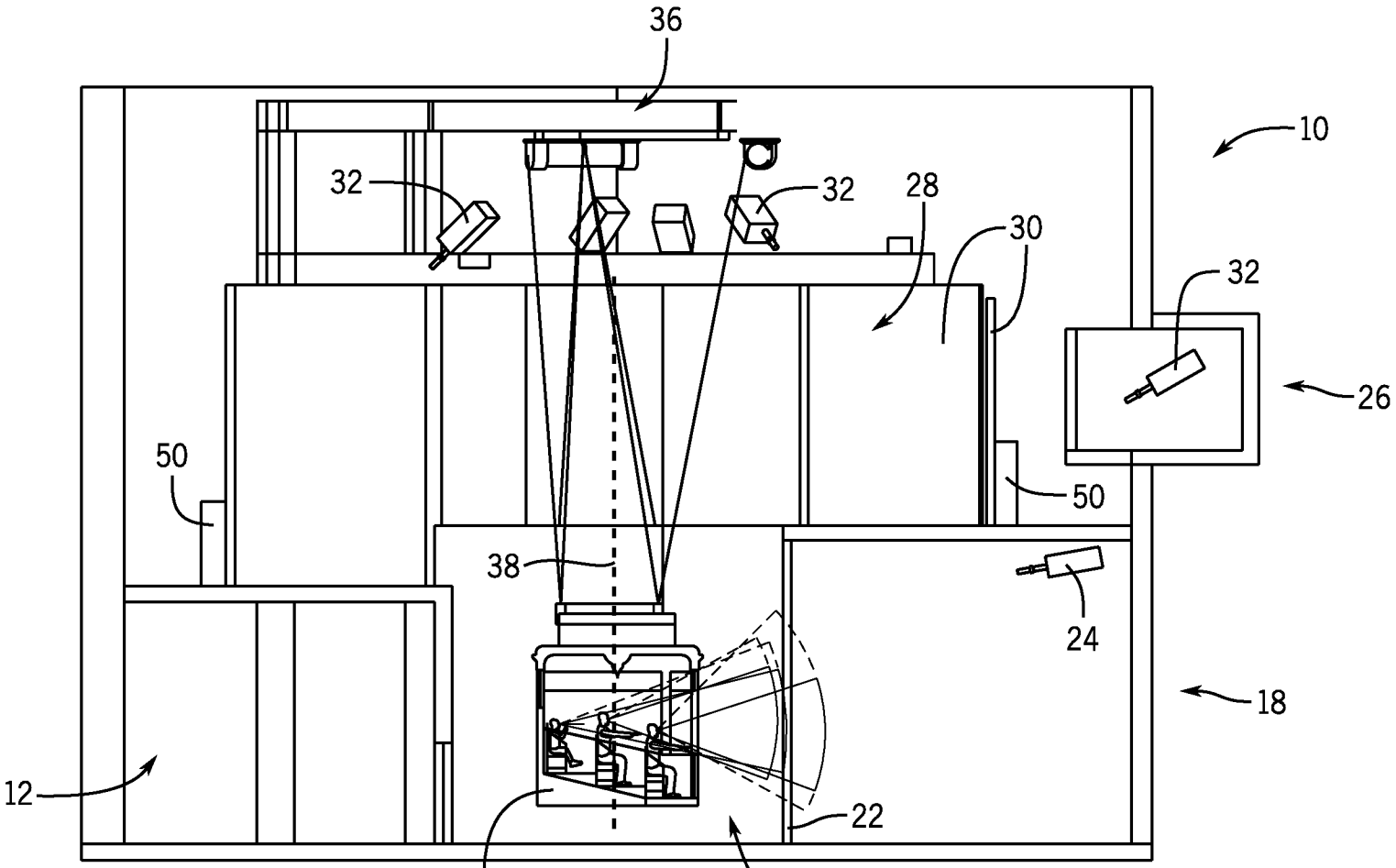
FIG. 2 is a side view of the dark ride tower system having a ride vehicle disposed in a stationary room in a lower level of the dark ride tower system, in accordance with an aspect of the present disclosure.
Figure 3:
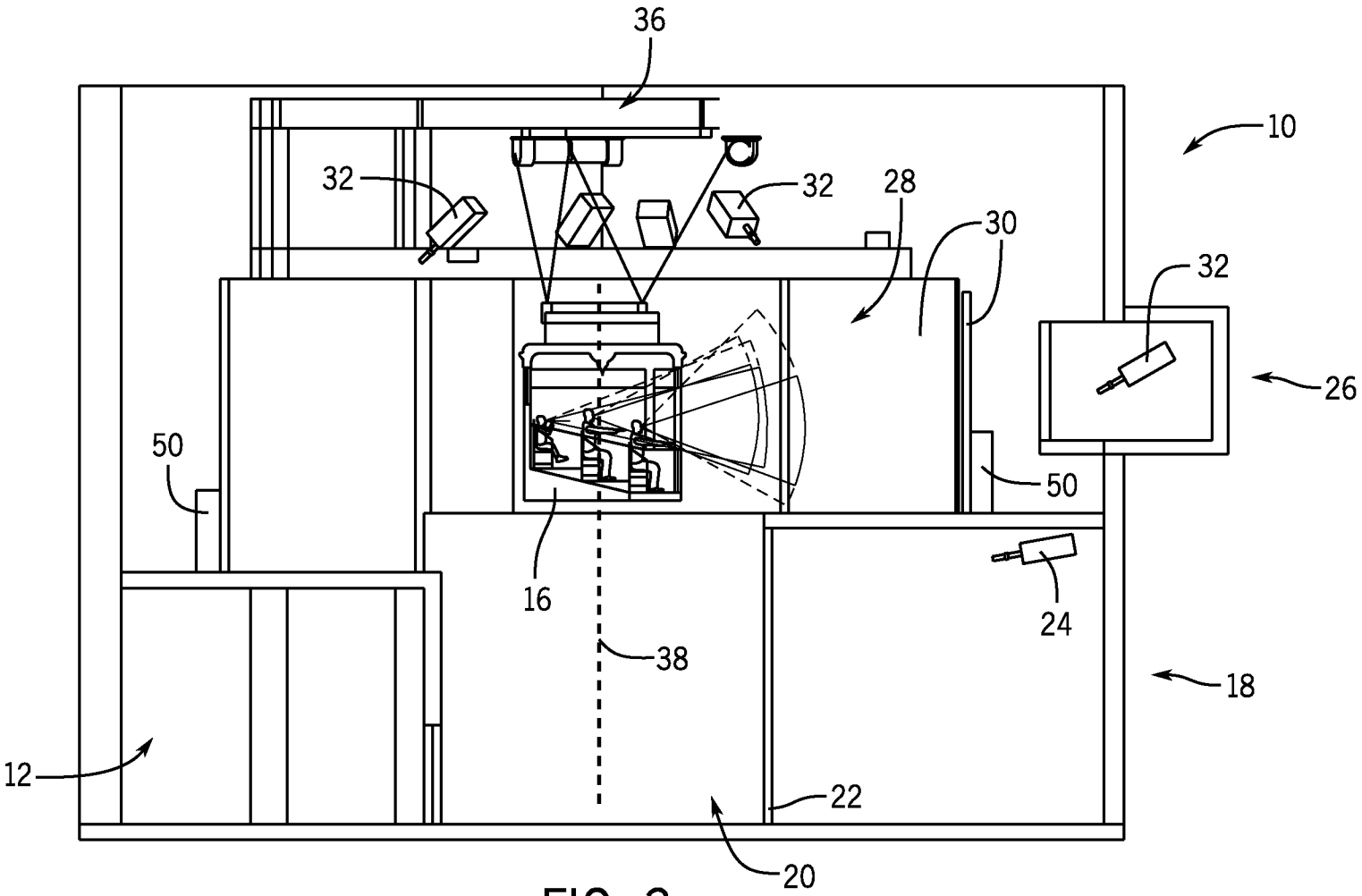
FIG. 3 is a side view of the dark ride tower system having the ride vehicle disposed in an adaptable room in an upper level of the dark ride tower system, in accordance with an aspect of the present disclosure.

As illustrated in FIG. 1 by arrows 34, in certain embodiments, the ride vehicle 16 may be moved between the lower and upper levels 18, 26 of the dark ride tower system 10 via a lift system 36, such as a suspension lift system or a ground lift system. For example, FIGS. 2 and 3 illustrate in greater detail how the ride vehicle 16 may be moved between the lower and upper levels 18, 26 of the dark ride tower system 10 via a suspension lift system 36. However, in other embodiments, the ride vehicle 16 may be moved between the lower and upper levels 18, 26 of the dark ride tower system 10 via other types of lift systems 36, such as ground lift systems. In certain embodiments, the lift system 36 utilizes several degrees of freedom to create sensations felt by guests 14 in the ride vehicle 16 that are not otherwise provided by conventional ride systems that include a limited number of degrees of freedom. For example, the lift system 36 may generate rotational motion by rotating the ride vehicle 16 (e.g., about an imaginary central axis 38 of the lift system 36) as well as generating translational motion of the ride vehicle 16 back and forth between the lower and upper levels 18, 26 of the dark ride tower system 10 (e.g., along the imaginary central axis 38 of the lift system 36). In addition, the lift system 36 may also move the ride vehicle 16 in further degrees of freedom (e.g., roll, pitch, and yaw) relative to the imaginary central axis 38 of the lift system 36). As such, the lift system 36 may move the ride vehicle 16 with six degrees of freedom (i.e., x, y, z, roll, pitch, and yaw) relative to any current position of the ride vehicle 16. Indeed, the ability of the lift system 36 to maneuver the ride vehicle 16 in a variety of ways further enhances the ability of the adaptable rooms 28 to present a variety of different projection mapped show scenes, as described in greater detail herein.

Although illustrated in the drawings, and described herein, as including a dark ride tower system 10 having one or more adaptable rooms 28 with adaptable walls 30 disposed above a stationary room 20 with stationary walls 22, in other embodiments, the stationary room 20 instead may be disposed above the one or more adaptable rooms 28. Indeed, in certain embodiments, the dark ride tower system 10 may include a stationary room 20 with stationary walls 22 and adaptable rooms 28 with adaptable walls 30 disposed both above and below the stationary room 20, as well as other combinations of physical configurations. In general, however, the stationary room 20 may be disposed adjacent the load/unload zone 12 in many of these embodiments insofar as this facilitates loading/unloading of guests 14 into/from the ride vehicle 16. In addition, in certain embodiments, the dark ride tower system 10 may include only one stationary room 20 and one adaptable room 28 within which the ride vehicle 16 may move, thereby simplifying the design of the dark ride tower system 10 while also enabling the presentation of near limitless combinations of show scenes and simulated movement between these show scenes.

As illustrated in FIG. 1, the functions of the dark ride tower system 10 described herein including, but not limited to, movement of the ride vehicle 16 caused by the lift system 36, movement of the adaptable walls 30 of the adaptable rooms 28, and generation of the projection mapped show scenes via the projectors 24, 32 may be controlled in response to control signals transmitted from one or more controllers 40. In certain embodiments, the controller(s) 40 may employ a processor 42, which may represent one or more processors, such as an application-specific processor. In certain embodiments, the controller(s) 40 may also include a memory device 44 storing instructions executable by the processor 42 to perform the methods and control actions described herein for the dark ride tower system 10. In certain embodiments, the processor 42 may include one or more processing devices, and the memory device 44 may include one or more tangible, non-transitory, machine-readable media. By way of example, such machine-readable media may include RAM, ROM, EPROM, EEPROM, CD-ROM, or other optical disk storage, magnetic disk storage or other magnetic storage devices, or any other medium that may be used to carry or store desired program code in the form of machine-executable instructions or data structures, and which may be accessed by the processor 42 or by any general purpose or special purpose computer or other machine with a processor.

In certain embodiments, the controller(s) 40 may utilize communication circuitry 46 to communicate with the components of the dark ride tower system 10 including, but not limited to, the lift system 36, the adaptable walls 30 of the adaptable rooms 28, and the projectors 24, 32. In certain embodiments, the communication circuitry 46 may communicate through a wireless network, such as wireless local area networks [WLAN], wireless wide area networks [WWAN], near field communication [NFC], Wi-Fi, and/or Bluetooth. In certain embodiments, the communication circuitry 46 may communicate through a wired network such as local area networks [LAN], or wide area networks [WAN]. By way of non-limiting example, the controller(s) 40 may synchronize or provide timing control between the movement of the ride vehicle 16 caused by the lift system 36, the movement of the adaptable walls 30 of the adaptable rooms 28, and the generation of the projection mapped show scenes via the projectors 24, 32 via communication of control signals to these components of the dark ride tower system 10 via the communication circuitry 46, as described in greater detail herein.

Figure 4:
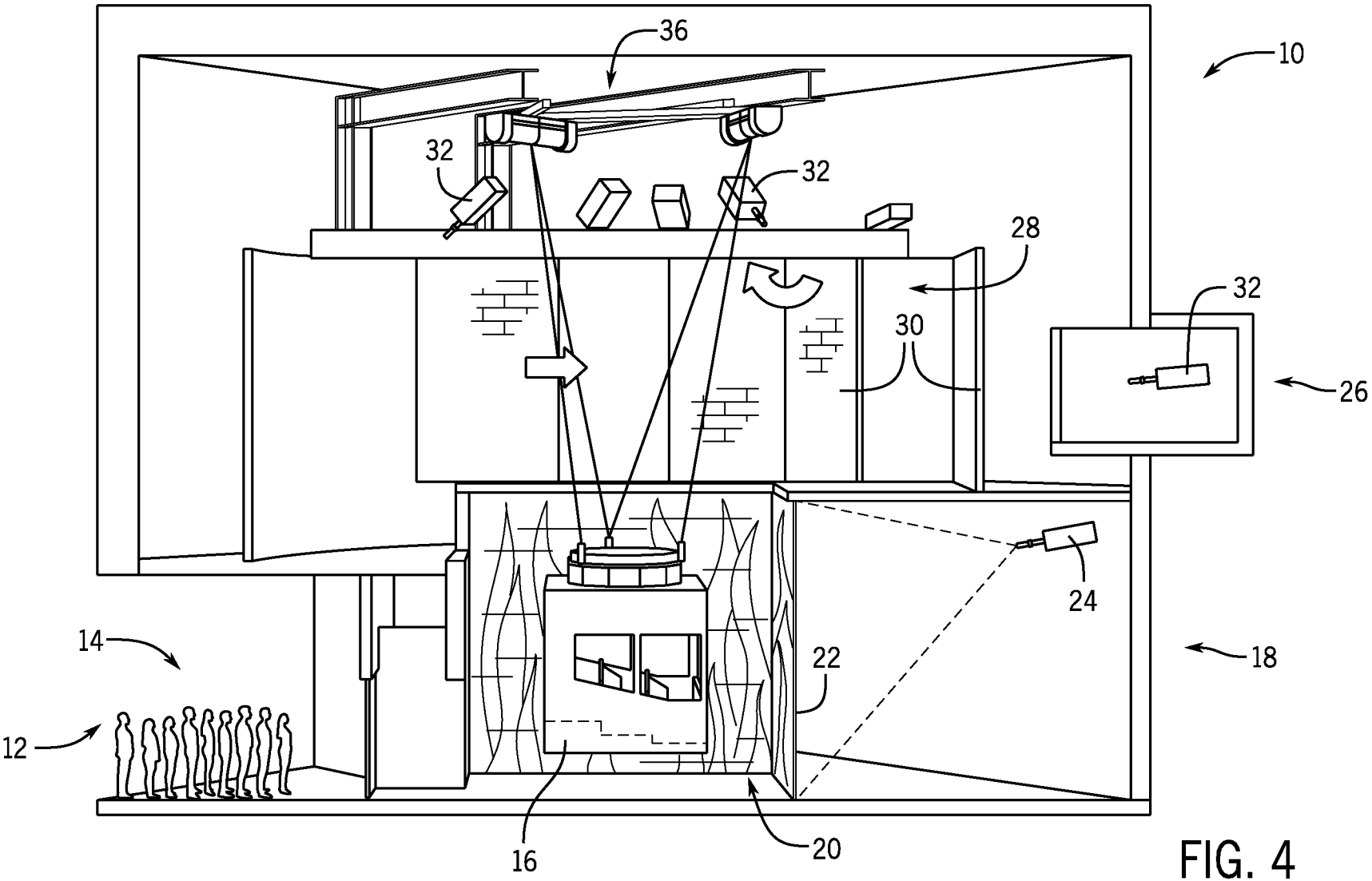
FIGS. 4 through 8 are side views of the dark ride tower system illustrating a sequence of events of the dark ride tower system, in accordance with an aspect of the present disclosure.
Figure 5:
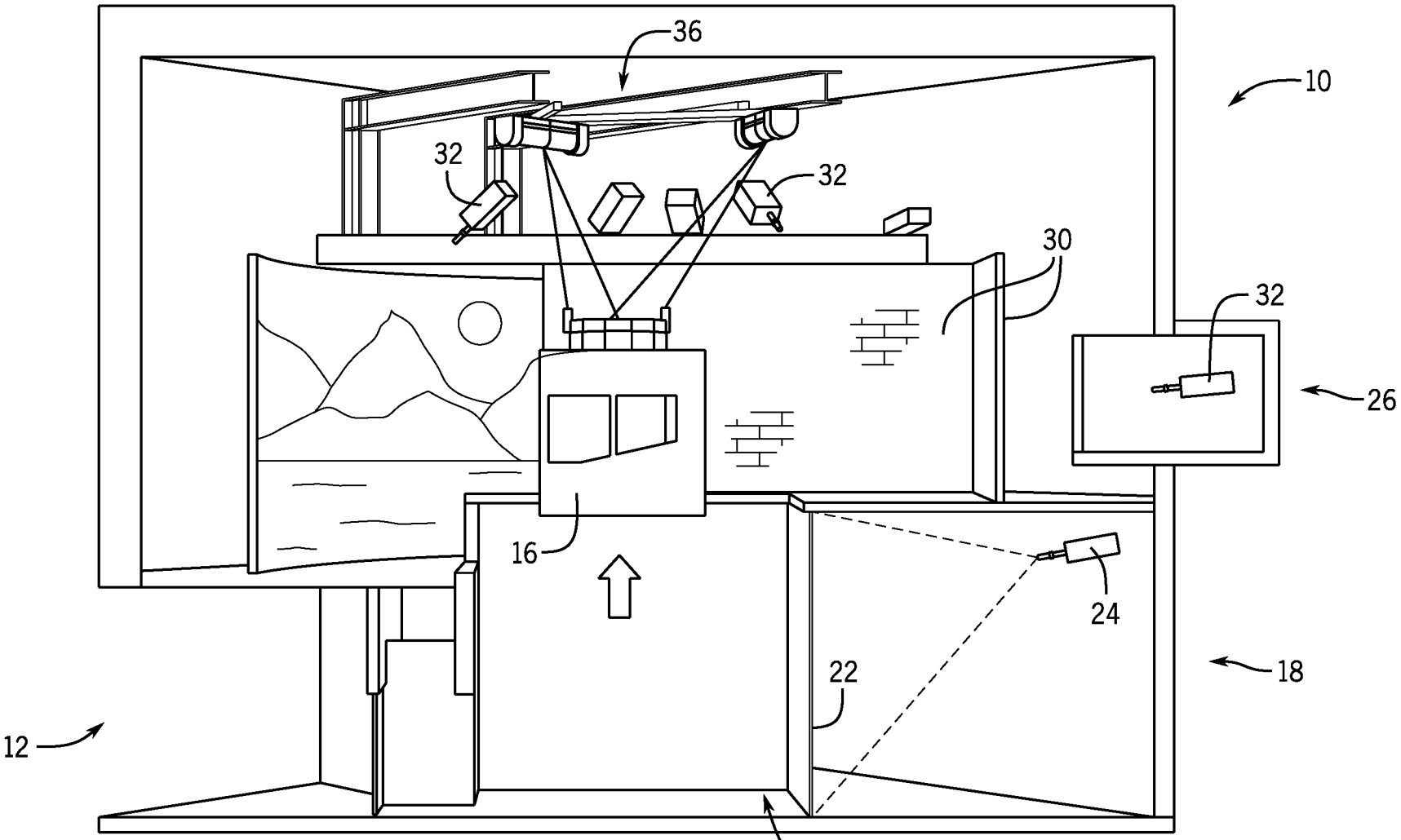

FIGS. 4 through 8 help illustrate the functionality of the dark ride tower system 10 described herein. It will be appreciated that the sequence of events illustrated in FIGS. 4 through 8 are merely exemplary, and not intended to be limiting. Indeed, near limitless combinations of movements and show scenes may be created via the components of the dark ride tower system 10, as described in greater detail herein. For example, FIGS. 9 through 20 illustrate an even more complex sequence of events, which may be created via the components of the dark ride tower system 10. As illustrated in FIG. 4, a sequence of events may start with the ride vehicle 16 being rotated and dropped into the lift shaft (i.e., of the lower level 18) for simulated travel and scene transition (e.g., via the upper level 26). At this point, media (e.g., projection mapping) may be generated by the lower projectors 24 on the stationary walls 22 of the stationary room 20 while the lift system 36 causes the ride vehicle 16 to pitch, roll, and/or heave to simulate horizontal and/or lateral movement of the ride vehicle 16 relative to the stationary room 20 (e.g., as if the ride vehicle 16 is travelling through a magic shaft, for example). While the ride vehicle 16 is disposed in the lift shaft (i.e., of the lower level 18), at least some of the adaptable walls 30 of the upper level 26 may be rearranged such that the show scene of the upper level 26 is reconfigured. As illustrated in FIG. 5, the ride vehicle 16 may then be rotated and lifted up into the upper level 26 by the lift system 36 where a projection mapped show set scene is presented on the adaptable walls 30 by one more upper projectors 32.

Figure 6:
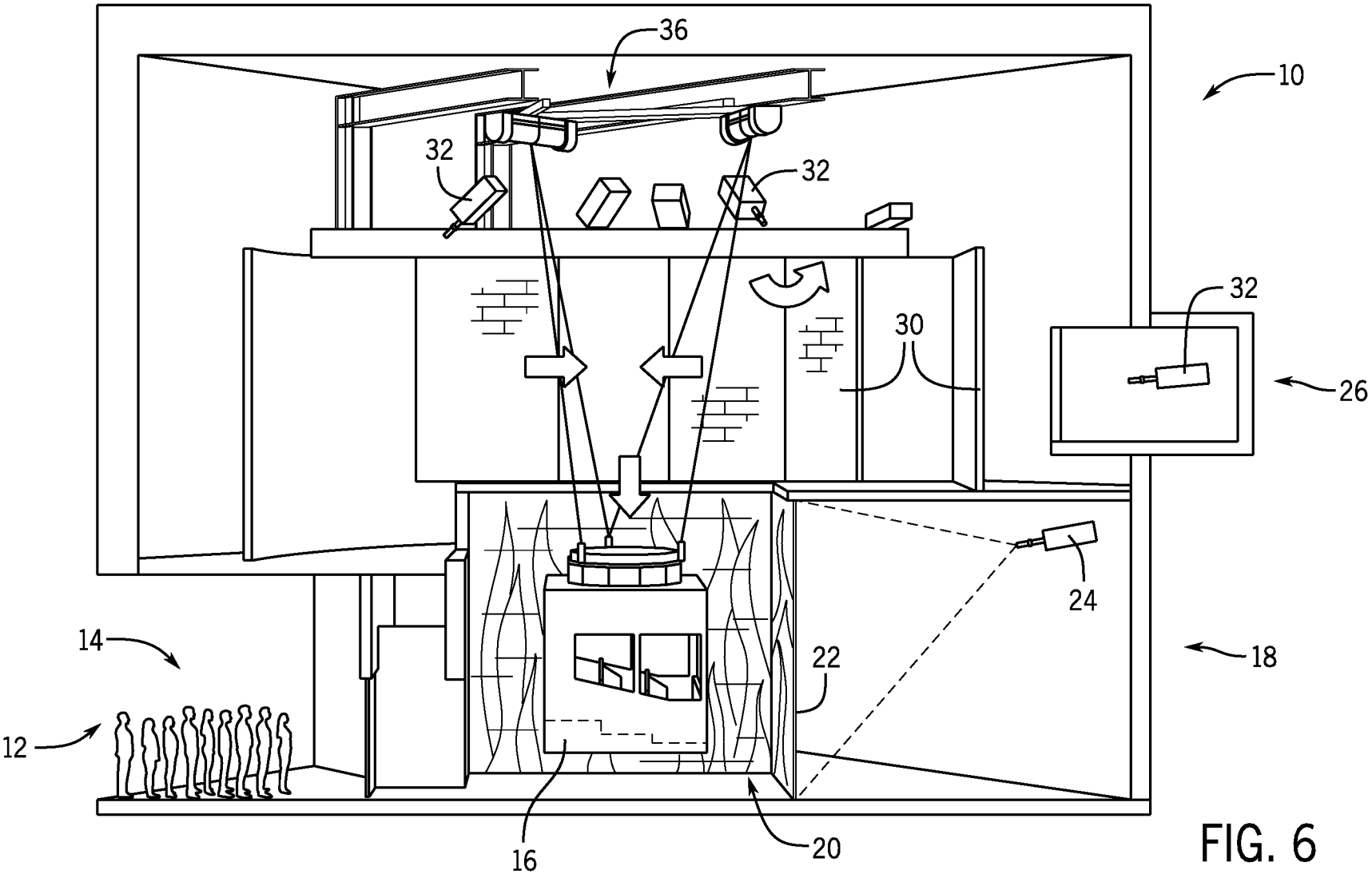
Figure 7:
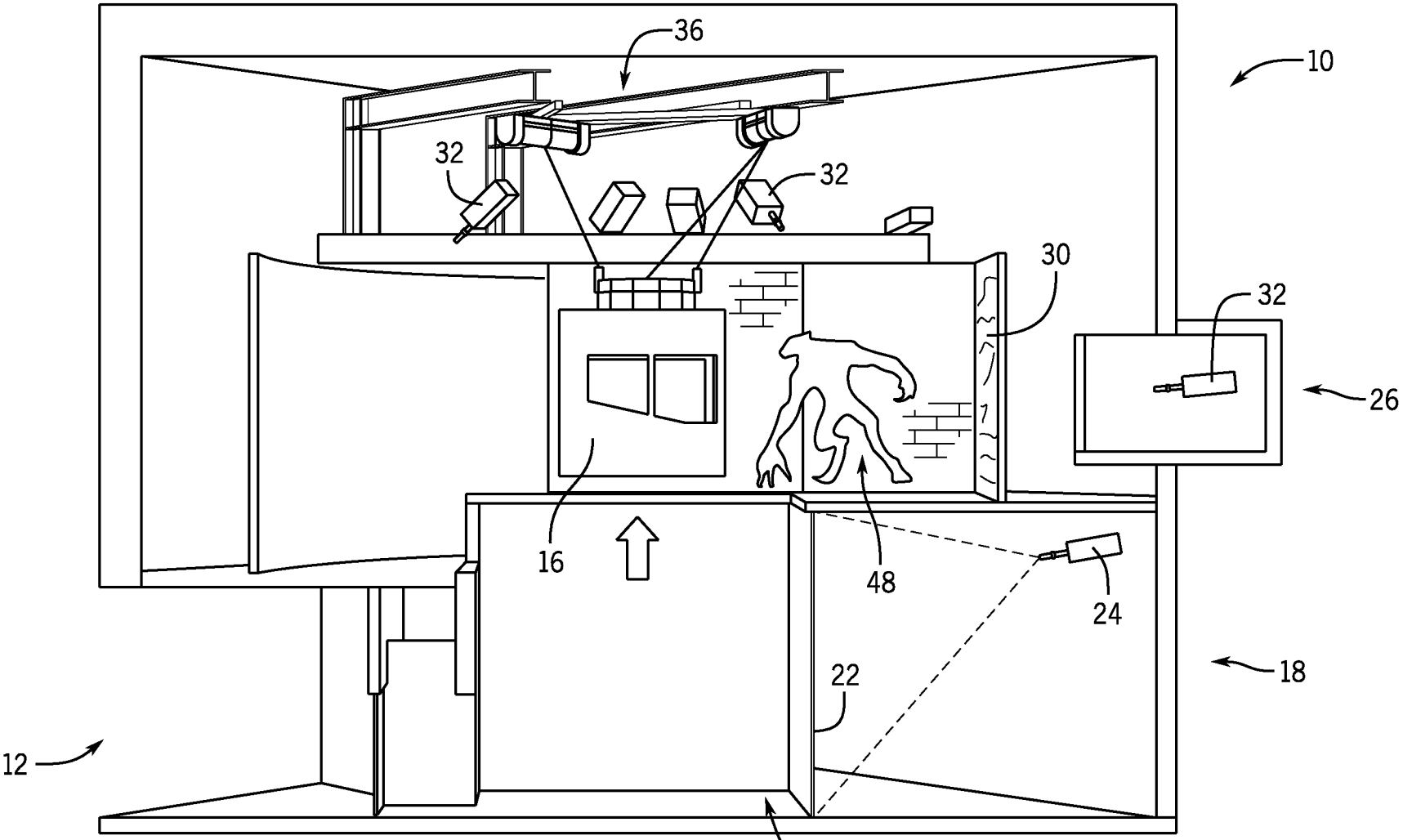

As illustrated in FIG. 6, after the projection mapped show set scene is presented, the ride vehicle 16 may again be rotated and dropped into the lift shaft (i.e., of the lower level 18) for simulated travel and scene transition (e.g., via the upper level 26). At this point, media (e.g., projection mapping) may be generated by the lower projectors 24 on the stationary walls 22 of the stationary room 20 while the lift system 36 causes the ride vehicle 16 to pitch, roll, and/or heave to again simulate horizontal and/or lateral movement of the ride vehicle 16 relative to the stationary room 20 (e.g., as if the ride vehicle 16 is travelling through a magic shaft, for example). While the ride vehicle 16 is disposed in the lift shaft (i.e., of the lower level 18), at least some of the adaptable walls 30 of the upper level 26 may be rearranged such that the show scene of the upper level 26 is again reconfigured into a different physical configuration. As illustrated in FIG. 7, the ride vehicle 16 may then be lifted up again into the upper level 26 by the lift system 36 where a different projection mapped show set scene is presented on the adaptable walls 30 by one more upper projectors 32. As illustrated in FIG. 7, one or more additional physical scene elements 48 (e.g., an animated figure in the illustrated embodiment) may be presented in this new show set scene.

Figure 8:
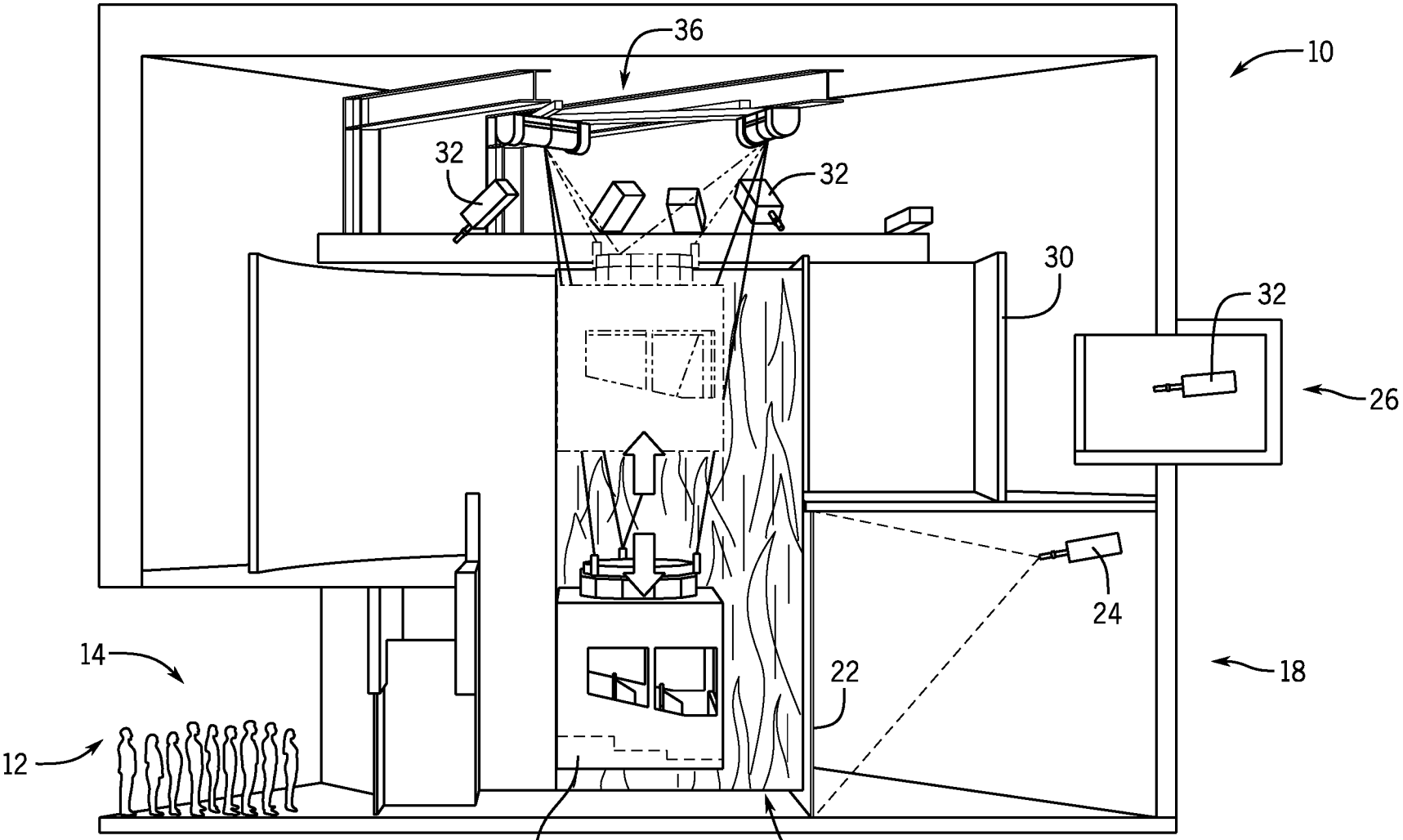

As illustrated in FIG. 8, in certain embodiments, the adaptable walls 30 may be reconfigured to vertically align with the stationary walls 22 of the lower level 18 to create a full height enclosed tower, and the walls 22, 30 may be projection mapped by the projectors 24, 32 while the lift system 36 causes the ride vehicle 16 to drop from maximum heave to simulate a gravity drop, both physically and visually. In certain embodiments, the ride vehicle 16 may reach minimum heave and the lift system 36 may quickly accelerate the ride vehicle 16 back upwards. Upon hitting the apex, guests 14 within the ride vehicle 16 may experience a moment of zero gravity as the ride vehicle 16 drops again. In certain embodiments, the lift system 36 may cause the ride vehicle 16 to repeat these drops and upward shots a number of times until finally settling at an unload position, at which point the guests 14 may disembark the ride vehicle 16.

Figure 9:
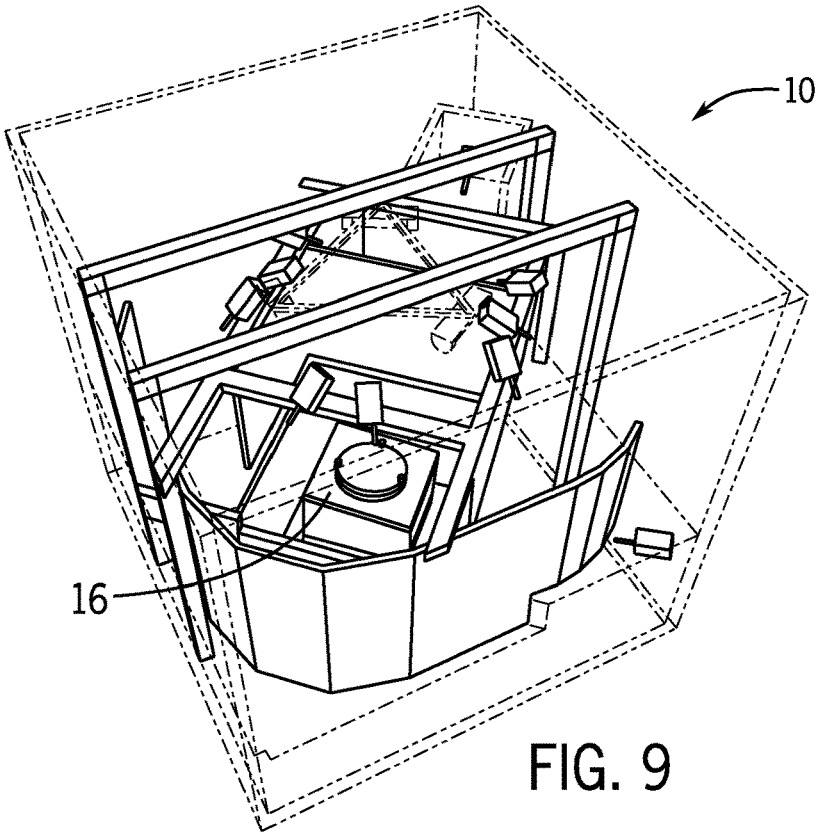
FIGS. 9 through 20 are side views of the dark ride tower system illustrating another sequence of events of the dark ride tower system, in accordance with an aspect of the present disclosure.
Figure 10:
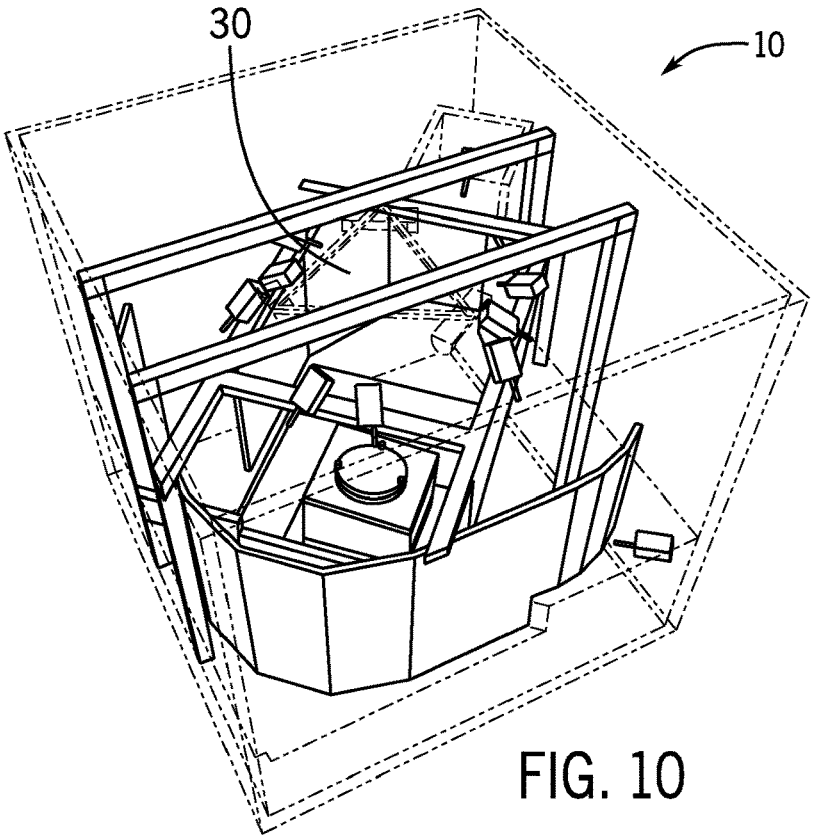
Figure 11:
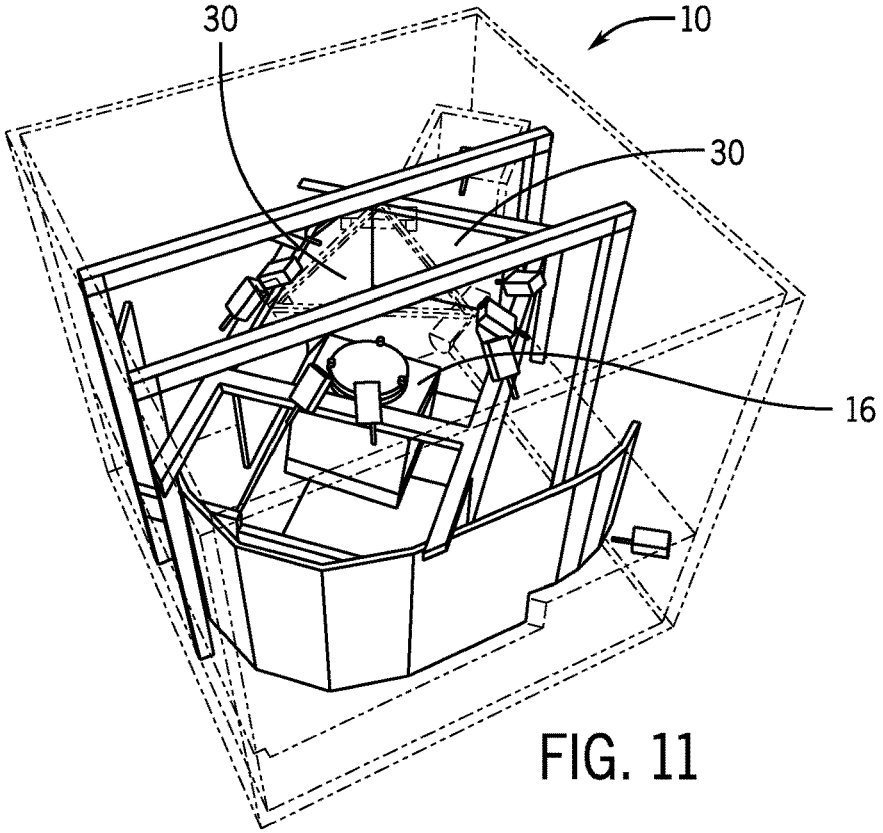

FIGS. 9 through 20 illustrate an even more complex sequence of events, which may be created via the components of the dark ride tower system 10. For example, FIG. 9 illustrates the ride vehicle 16 disposed in the lift shaft (i.e., of the lower level 18) as simulated movement of the ride vehicle 16 is generated by the lower projectors 24 and the lift system 36, as described in greater detail herein. While this is occurring, one or more adaptable walls 30 may be reconfigured, as illustrated in FIG. 10. Then, as illustrated in FIG. 11, the ride vehicle 16 may be lifted by the lift system 36 and a projection mapped show scene may be presented on one or more of the adaptable walls 30 by the upper projectors 32, as described in greater detail herein.

Figure 12:
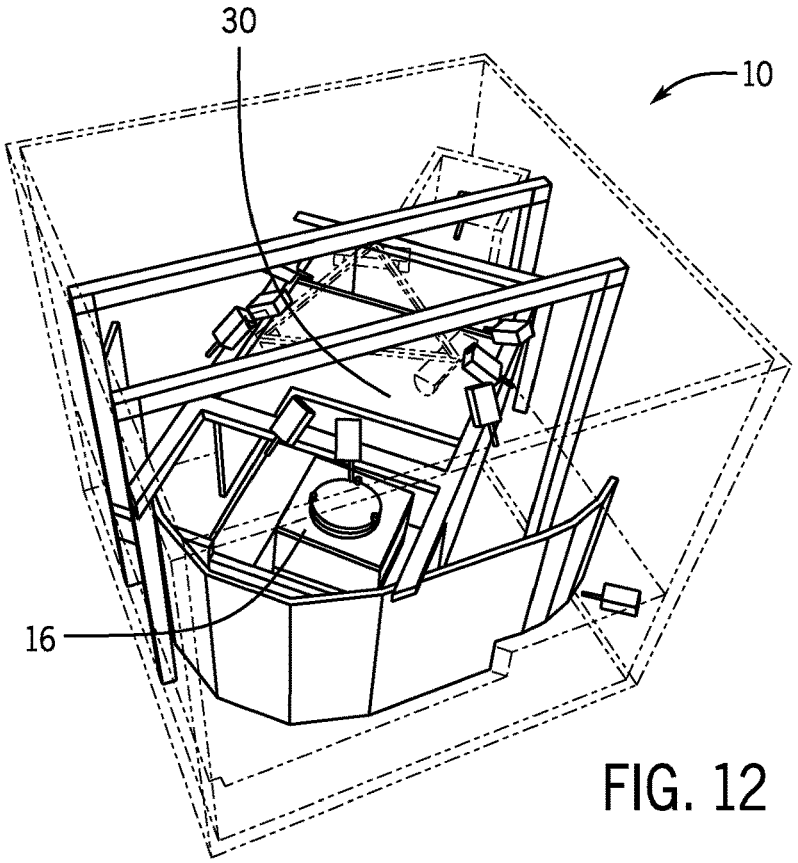
Figure 13:
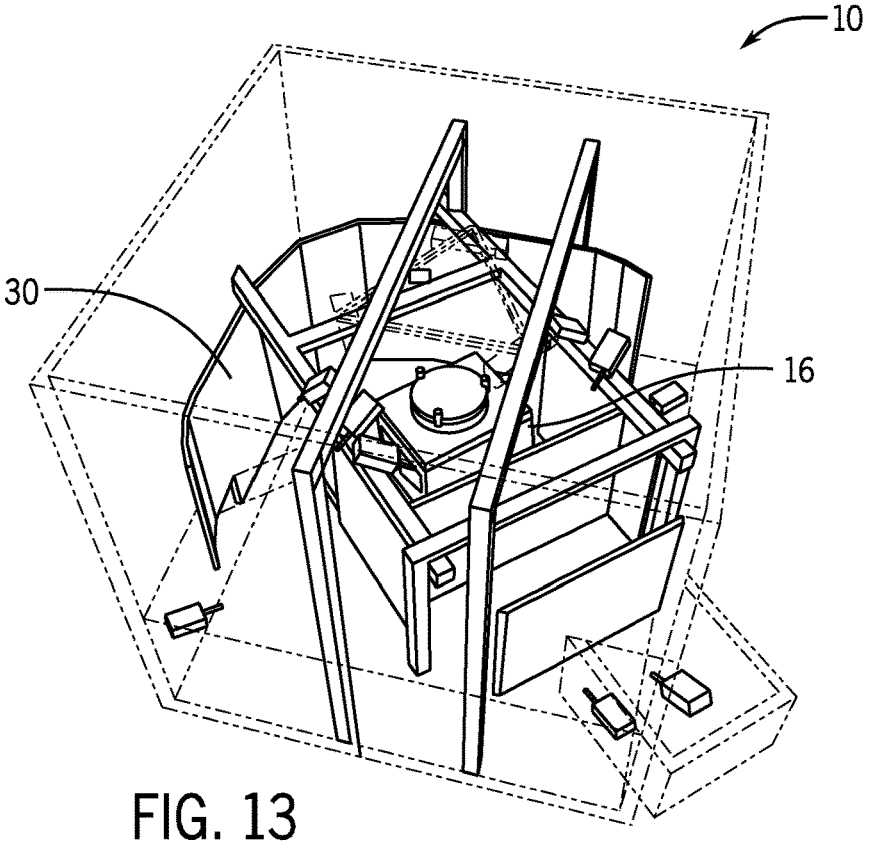

Then, as illustrated in FIG. 12, the ride vehicle 16 may be dropped back down into the lift shaft (i.e., of the lower level 18) by the lift system 36 and simulated movement of the ride vehicle 16 may again be generated by the lower projectors 24 and the lift system 36, as described in greater detail herein. While this is occurring, one or more adaptable walls 30 may again be reconfigured, as also illustrated in FIG. 12. Then, as illustrated in FIG. 13, the ride vehicle 16 may be lifted and rotated by the lift system 36 and a different projection mapped show scene may be presented on one or more of the adaptable walls 30 by the upper projectors 32, as described in greater detail herein.

Figure 14:
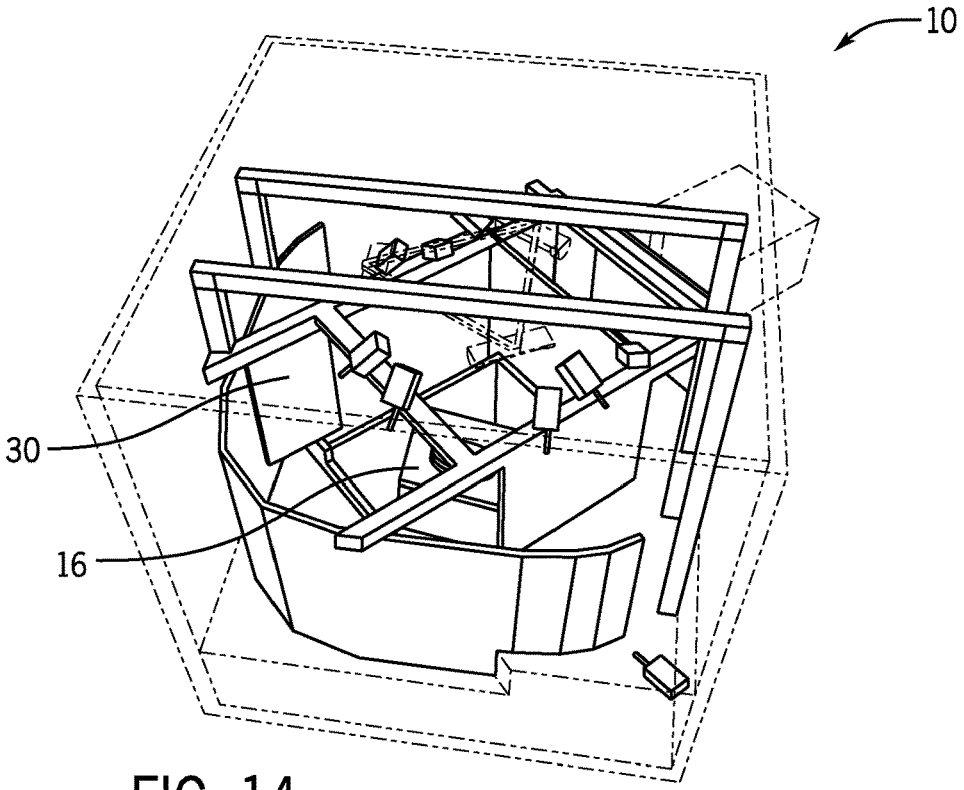
Figure 15:
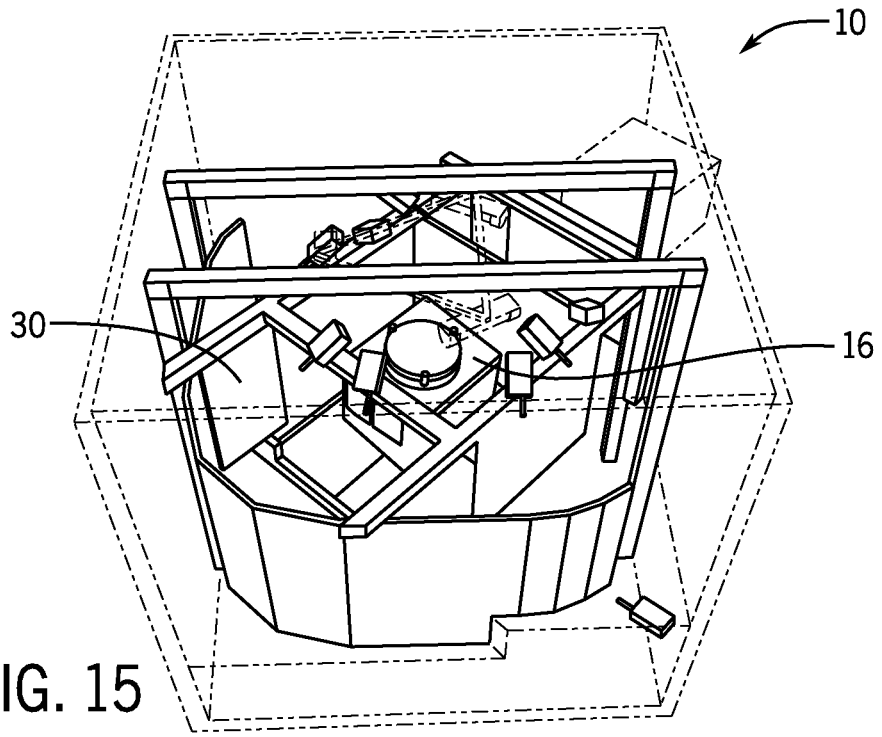

Then, as illustrated in FIG. 14, the ride vehicle 16 may again be dropped back down into the lift shaft (i.e., of the lower level 18) and rotated by the lift system 36 and simulated movement of the ride vehicle 16 may again be generated by the lower projectors 24 and the lift system 36, as described in greater detail herein. While this is occurring, one or more adaptable walls 30 may again be reconfigured, as also illustrated in FIG. 14. Then, as illustrated in FIG. 15, the ride vehicle 16 may be lifted and rotated by the lift system 36 and a different projection mapped show scene may be presented on one or more of the adaptable walls 30 by the upper projectors 32, as described in greater detail herein.

Figure 16:
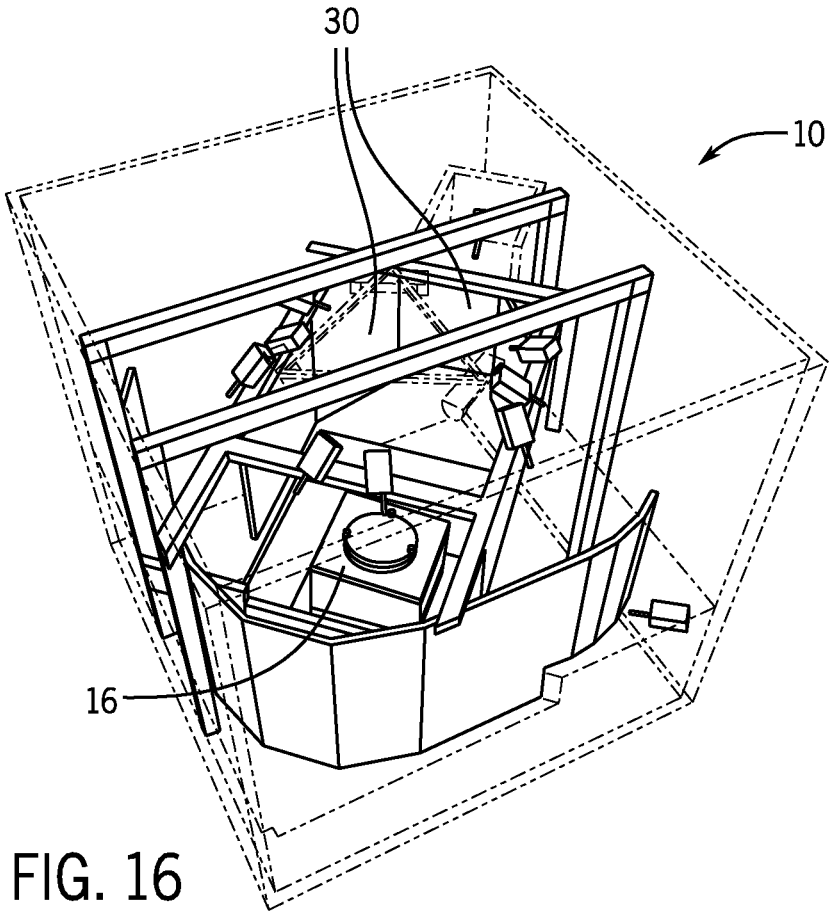
Figure 17:
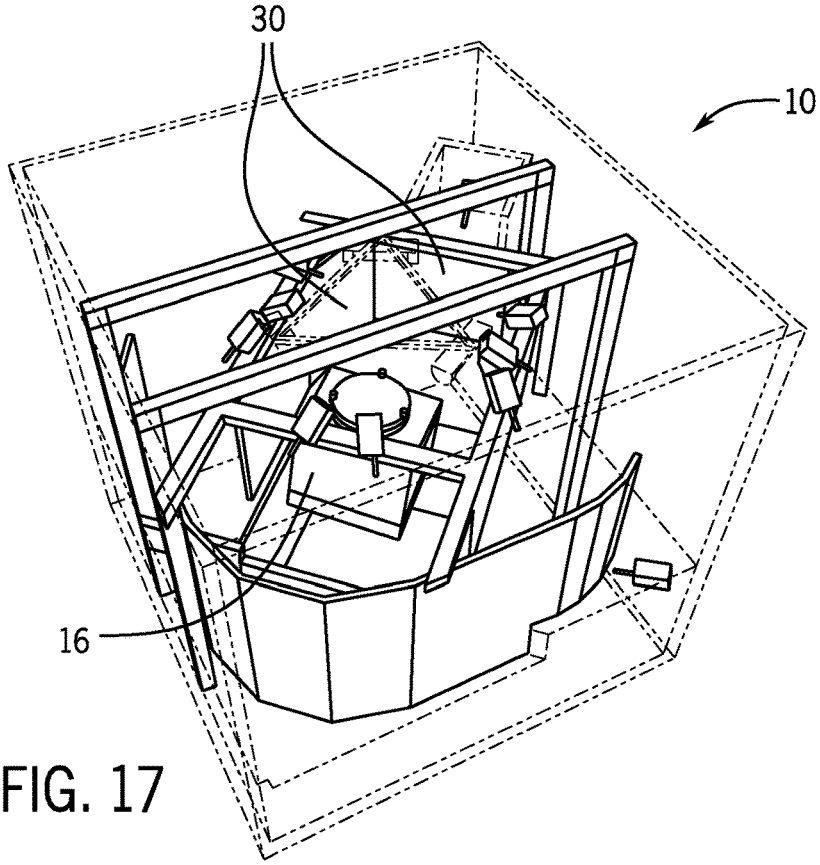

Then, as illustrated in FIG. 16, the ride vehicle 16 may again be dropped back down into the lift shaft (i.e., of the lower level 18) and rotated by the lift system 36 and simulated movement of the ride vehicle 16 may again be generated by the lower projectors 24 and the lift system 36, as described in greater detail herein. While this is occurring, one or more adaptable walls 30 may again be reconfigured, as also illustrated in FIG. 16. Then, as illustrated in FIG. 17, the ride vehicle 16 may be lifted by the lift system 36 and a different projection mapped show scene may be presented on one or more of the adaptable walls 30 by the upper projectors 32, as described in greater detail herein.

Figure 18:
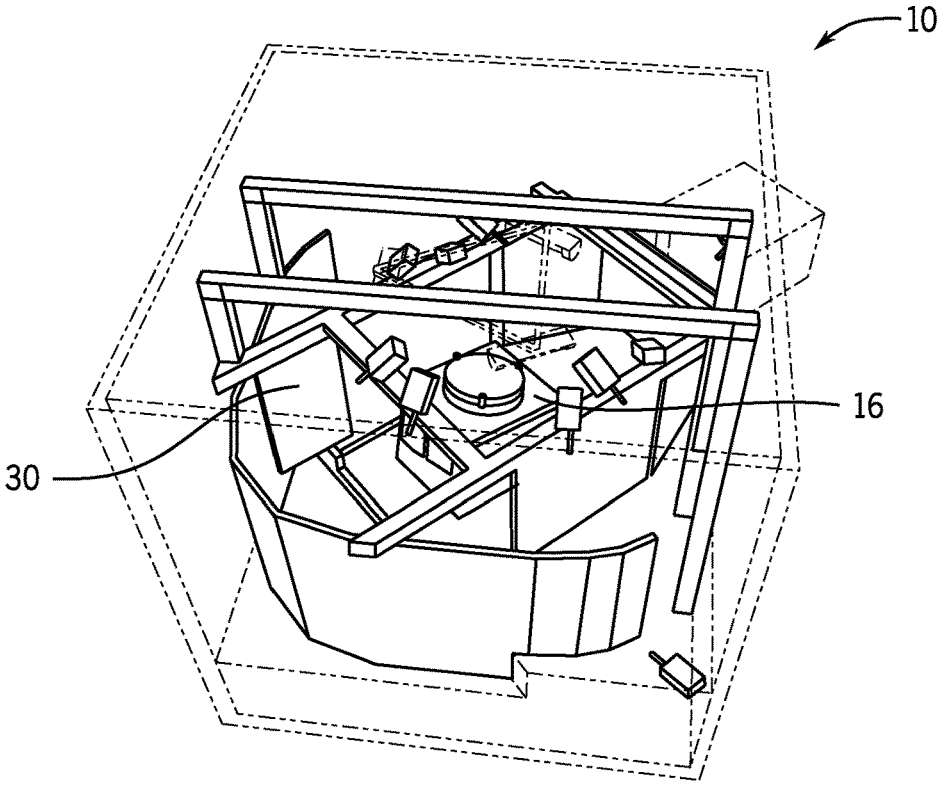
Figure 19:
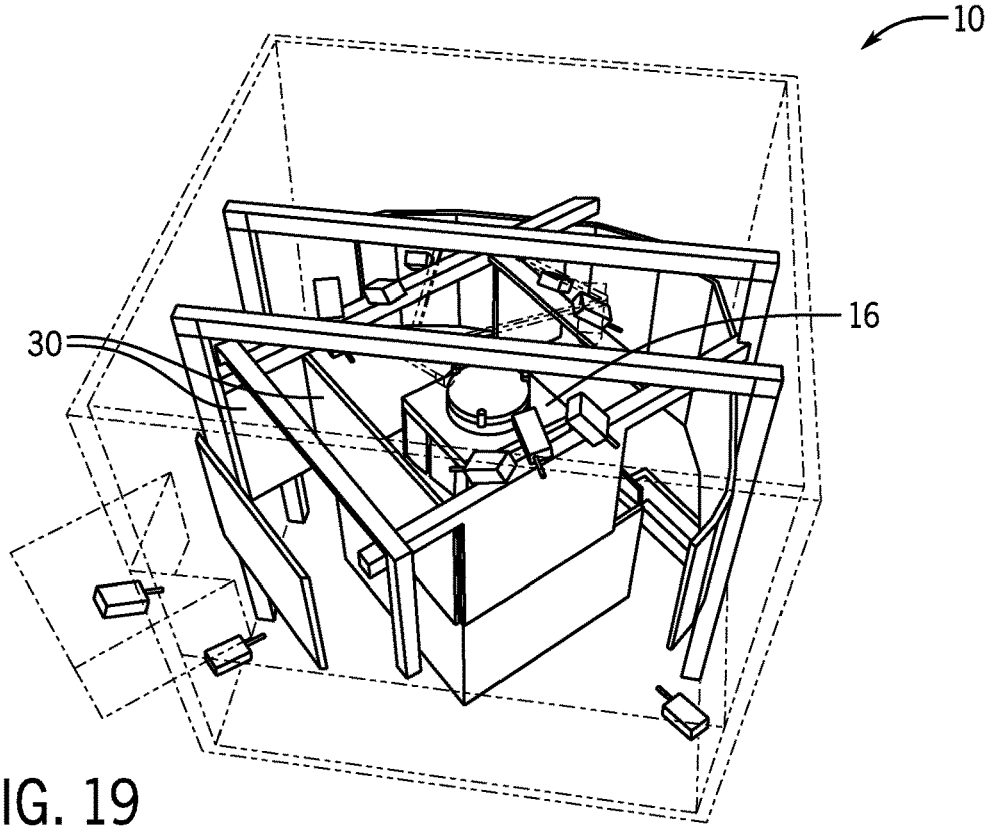
Figure 20:
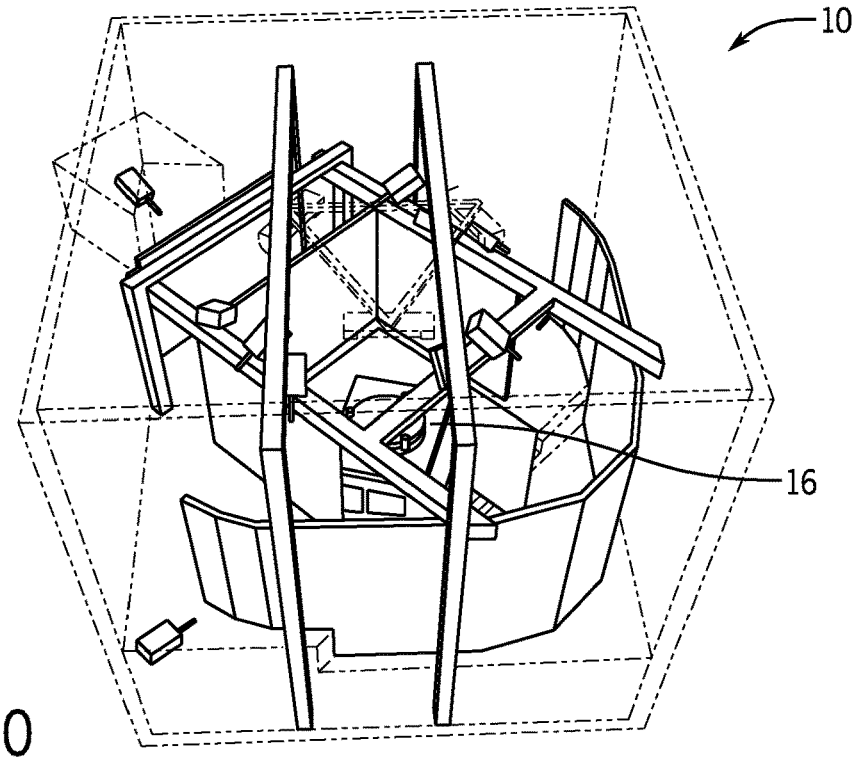

In certain instances, different projection mapped show scenes may be presented without dropping the ride vehicle 16 into the lift shaft (i.e., of the lower level 18). For example, as illustrated in FIGS. 18 and 19, the ride vehicle 16 may be rotated by the lift system 36 while one or more adaptable walls 30 are reconfigured and different projection mapped show scenes are presented on one or more of the adaptable walls 30 by the upper projectors 32, as described in greater detail herein. At some point, as illustrated in FIG. 20, the ride vehicle 16 may again be dropped back down into the lift shaft (i.e., of the lower level 18) by the lift system 36, and the ride may end. At this point, the guests 14 may disembark from the ride vehicle 16 via the load/unload zone 12, as described in greater detail herein.

As described in greater detail herein, the adaptable walls 30 of the adaptable rooms 28 may be configured to be actuated such that the adaptable walls 30 move into various different physical configurations. For example, as illustrated in FIGS. 2 and 3, the adaptable rooms 28 may include a plurality of actuators 50 configured to cause the adaptable walls 30 to move, as described in greater detail herein. The actuators 50 may include any type of actuators that may be physically coupled to the adaptable walls 30, and may be configured to receive control signals (e.g., from the controller(s) 40) to move the adaptable walls 30 into different physical configurations, and to apply forces to the adaptable walls 30 to move the adaptable walls 30 in accordance with the received control signals.

Indeed, as described in greater detail herein, the controller(s) 40 illustrated in FIG. 1 may be configured to synchronize the functionality of the individual components of the dark ride tower system 10 to enhance the experiences of the guests 14. In particular, the controller(s) 40 may be configured to send control signals to the projectors 24, 32, the lift system 36, the actuators 50, as well as other components of the dark ride tower system 10 to synchronize or provide timing control between the movement of the ride vehicle 16 caused by the lift system 36, the movement of the adaptable walls 30 of the adaptable rooms 28, and the generation of the projection mapped show scenes via the projectors 24, 32, as described in greater detail herein.

Figure 21:
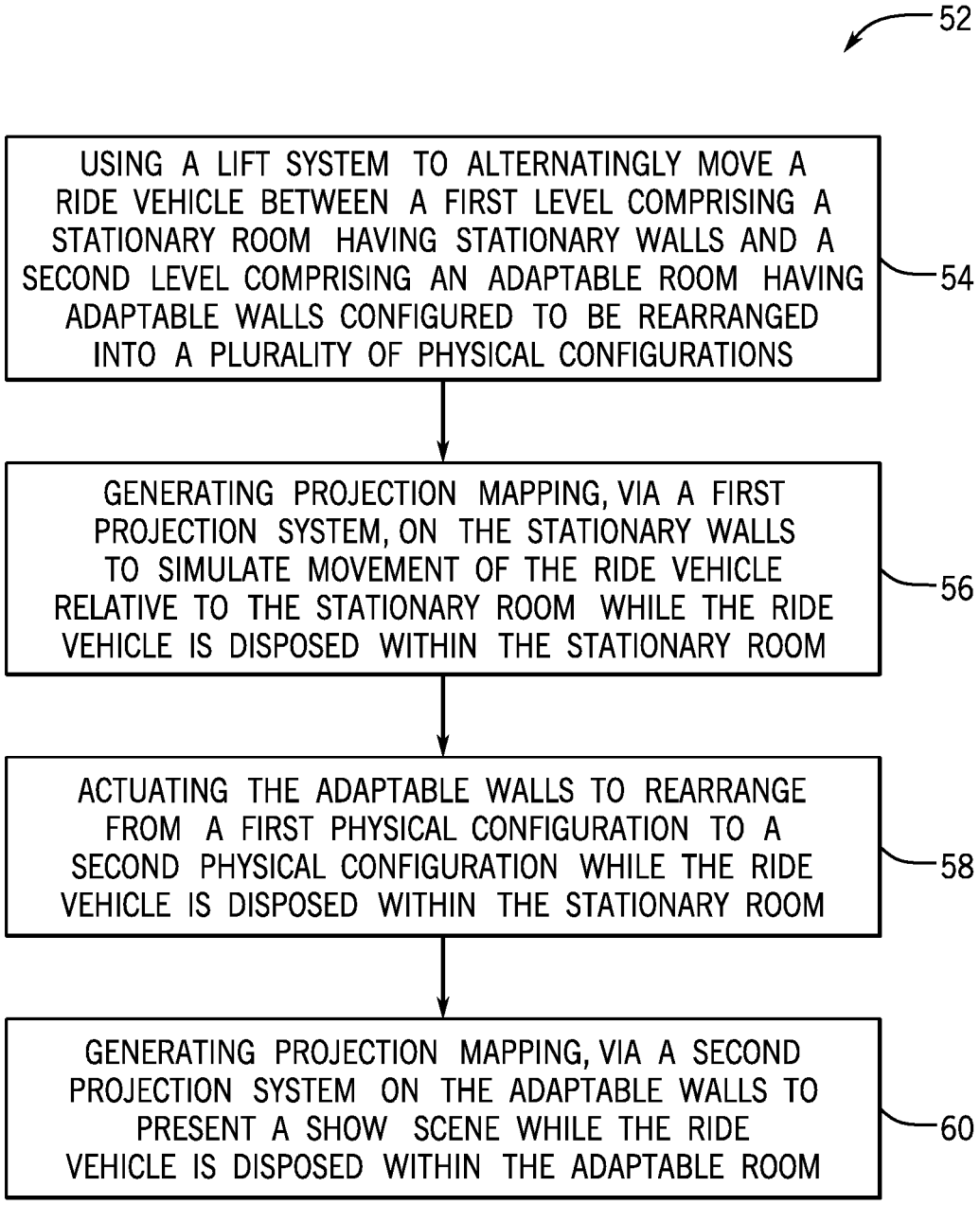
FIG. 21 is a flow diagram of a method of controlling the dark ride tower system, in accordance with an aspect of the present disclosure.

FIG. 21 is a flow diagram of a method 52 of controlling the dark ride tower system 10, as described in greater detail herein. As illustrated in FIG. 21, in certain embodiments, the method 52 may include using the lift system 36 to alternatingly move the ride vehicle 16 between a first level (e.g., the lower level 18) that includes a stationary room 20 having stationary walls 22 and a second level (e.g., the upper level 26) that includes an adaptable room 28 having adaptable walls 30 configured to be rearranged into a plurality of physical configurations (block 54). In addition, in certain embodiments, the method 52 may include generating projection mapping, via a first projection system (e.g., the lower level projectors 24), on the stationary walls 22 to simulate movement of the ride vehicle 16 relative to the stationary room 20 while the ride vehicle 16 is disposed within the stationary room 20 (block 56). In addition, in certain embodiments, the method 52 may include actuating the adaptable walls 30 to rearrange from a first physical configuration to a second physical configuration while the ride vehicle 16 is disposed within the stationary room 20 (block 58). In addition, in certain embodiments, the method 52 may include generating projection mapping, via a second projection system (e.g., the upper level projectors 32), on the adaptable walls 30 to present a show scene while the ride vehicle 16 is disposed within the adaptable room 28 (block 60).

In addition, in certain embodiments, the method 52 may include using the lift system 36 to pitch, roll, and/or heave the ride vehicle 16 while the first projection system (e.g., the lower level projectors 24) generates the projection mapping on the stationary walls 22 to simulate horizontal and/or lateral movement of the ride vehicle 16. In addition, in certain embodiments, the method 52 may include actuating the adaptable walls 30 of the adaptable room 28 to align vertically with the stationary walls 22 of the stationary room 20 to create a fully enclosed tower. In addition, in certain embodiments, the method 52 may include generating, via the first and second projection systems (e.g., the lower and upper level projectors 24, 32), synchronized projection mapping on both the adaptable walls 30 and the stationary walls 22 while the adaptable walls 30 and the stationary walls 22 are vertically aligned to simulate a gravity drop visually. In addition, in certain embodiments, the method 52 may include using the lift system 36 to drop the ride vehicle 16 to simulate the gravity drop physically. In addition, in certain embodiments, the method 52 may include any of the other techniques described herein.

Figure 23:
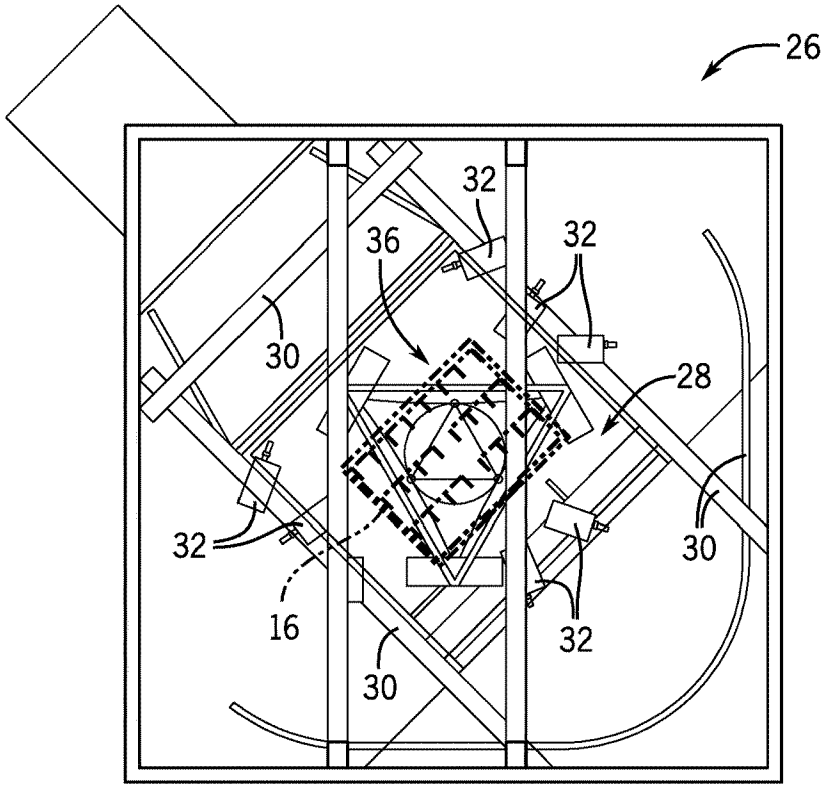
FIGS. 22 and 23 are top views of the lower level and the upper level, respectively, of the dark ride tower system, in accordance with an aspect of the present disclosure.
Figure 22:
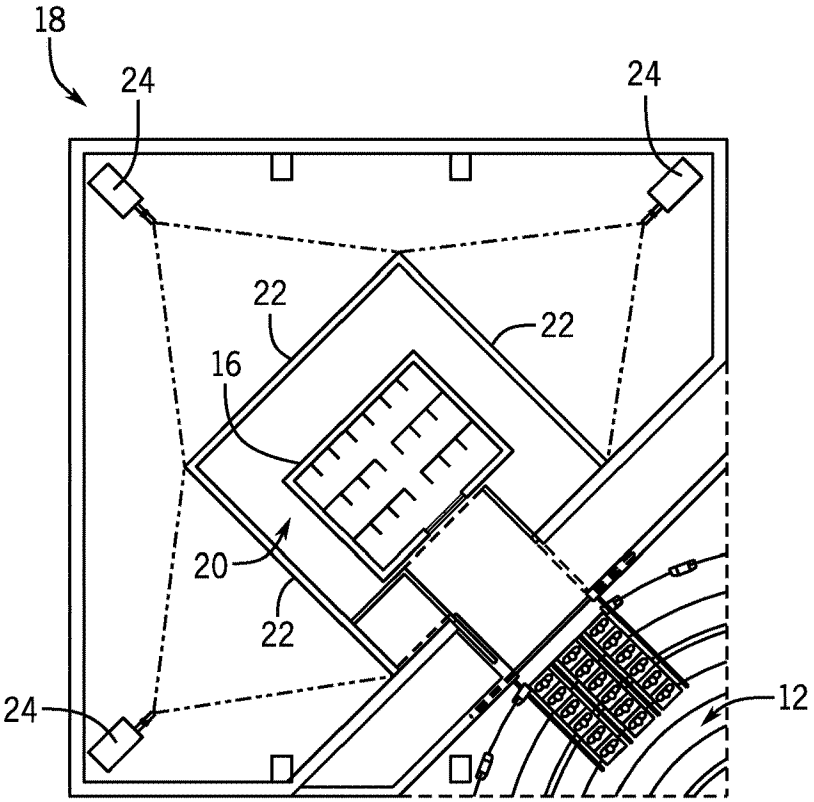
Figure 24:
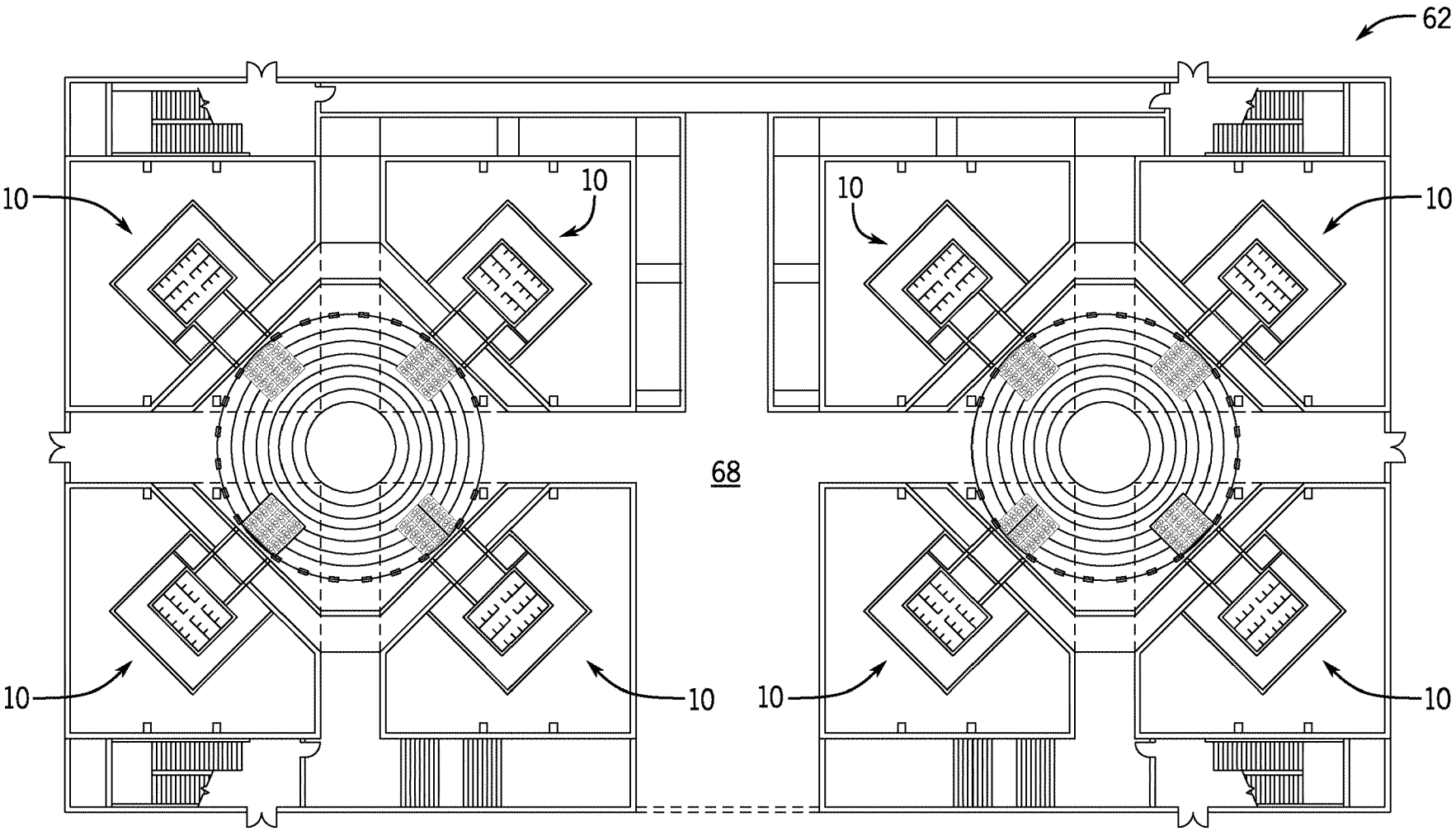
FIGS. 24 through 27 are top views of a plurality of dark ride tower systems arranged in different layouts of dark ride tower system complexes, in accordance with an aspect of the present disclosure.
Figure 25:
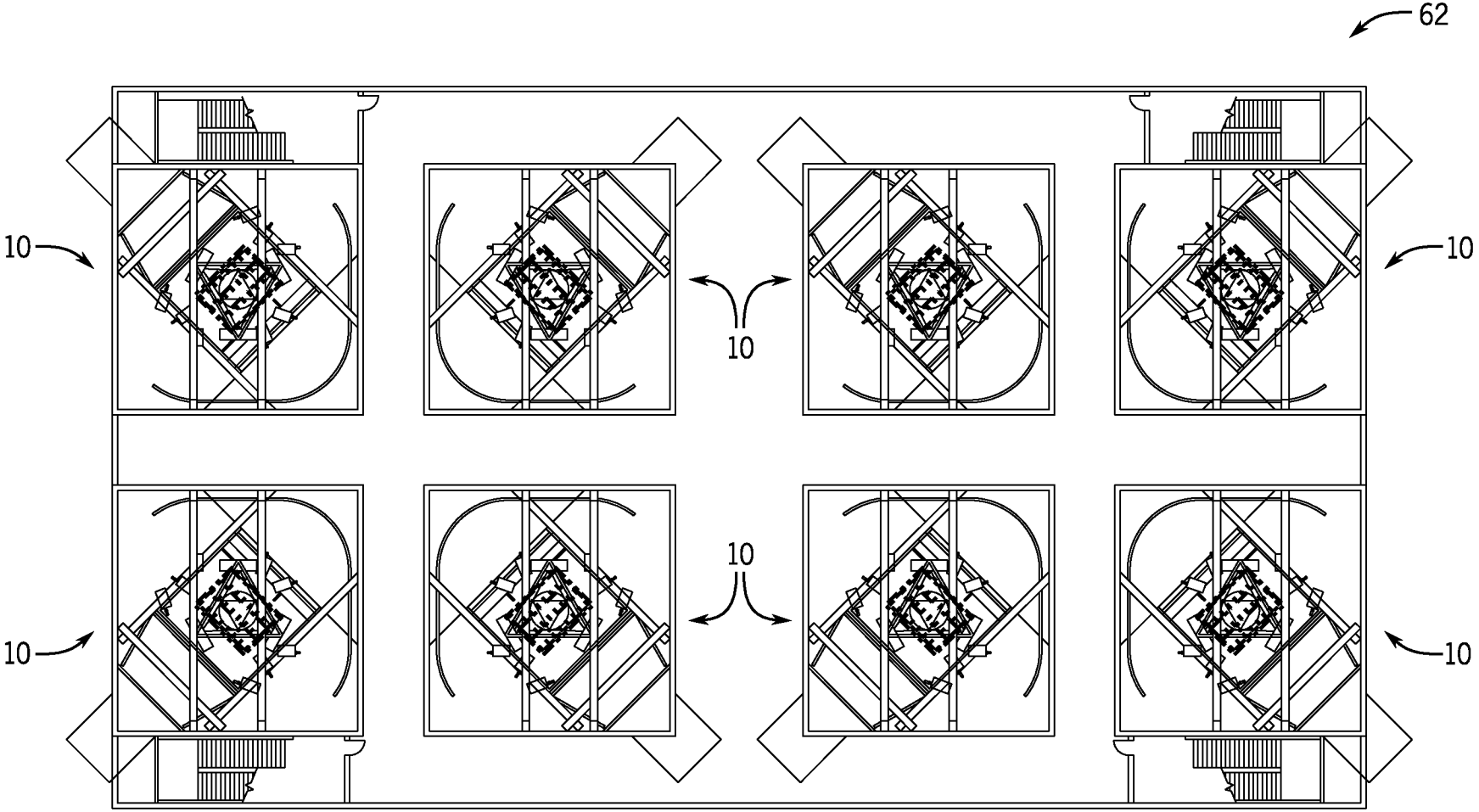
Figure 26:
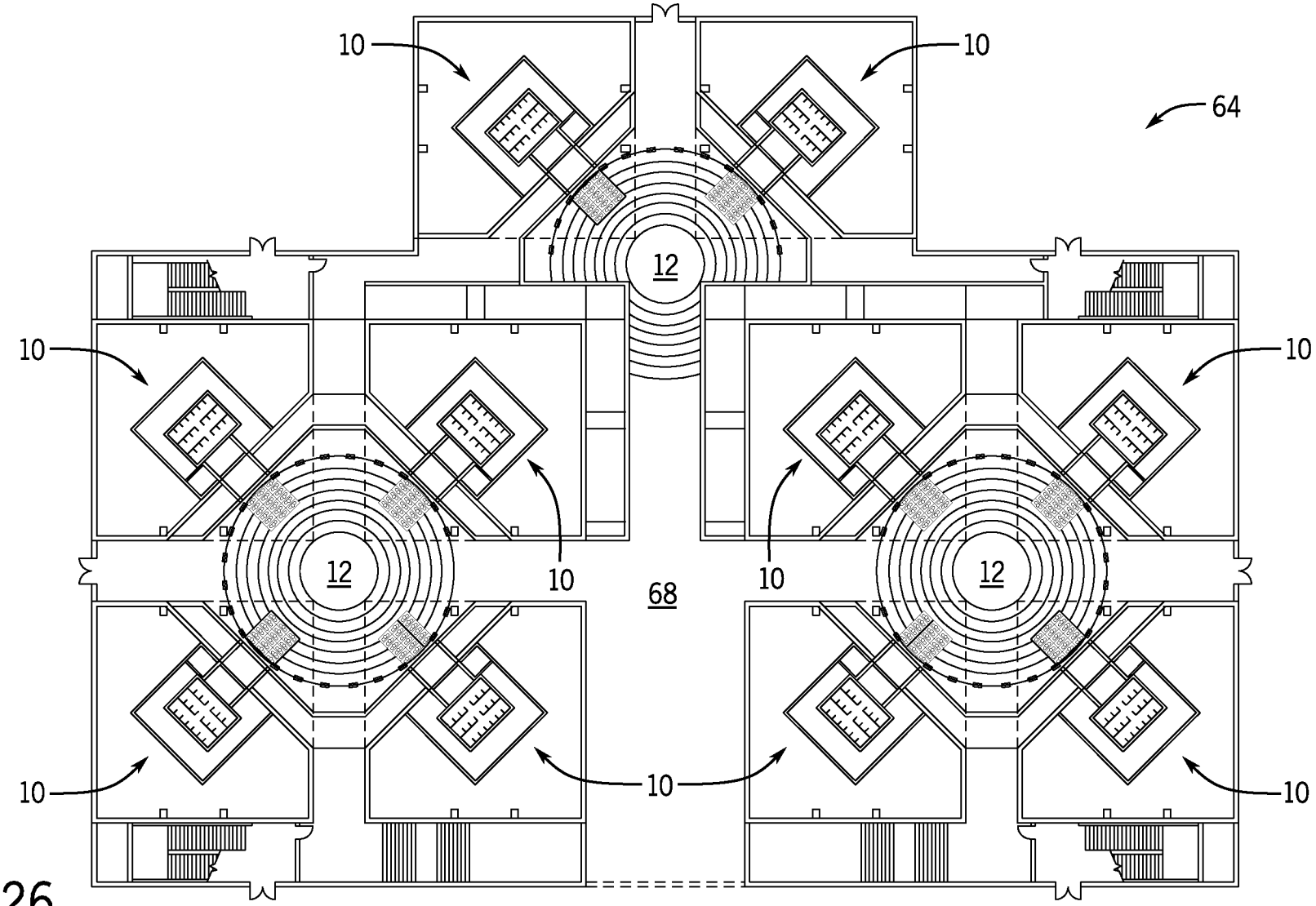
Figure 27:
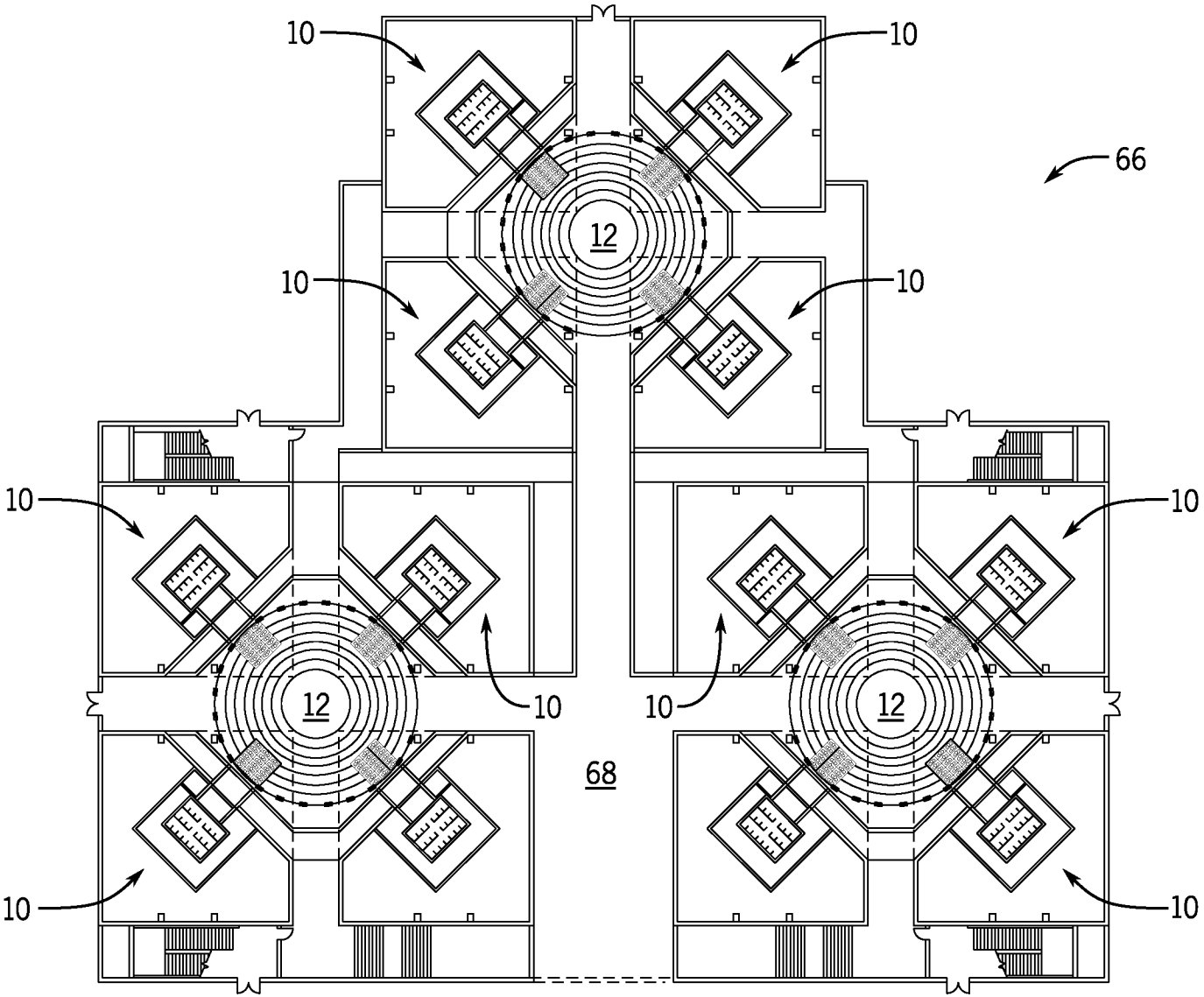

FIGS. 22 and 23 are top views of the lower level 18 and the upper level 26, respectively, of the dark ride tower system 10. The specific components and configuration of components is merely exemplary and not intended to be limiting. In certain embodiments, more than one dark ride tower system 10 described herein may be combined into a dark ride tower system complex of an amusement park. FIGS. 24 through 27 are top views of a plurality of dark ride tower systems 10 arranged in different layouts of dark ride tower system complexes 62, 64, 66. For example, FIGS. 24 and 25 are top views of the lower levels 18 and the upper levels 26, respectively, of eight dark ride tower systems 10 arranged into a dark ride tower system complex 62. In addition, FIGS. 26 and 27 are top views of the lower levels 18 of ten and twelve dark ride tower systems 10 arranged into dark ride tower system complexes 64, 66, respectively. As illustrated in FIGS. 24, 26, and 27, the plurality of dark ride tower systems 10 may share a common entryway 68, which provides access to the respective load/unload zones 12 of the dark ride tower systems 10. As described in greater detail herein, an advantage of the dark ride tower systems 10 arranged is the ability to deliver near limitless different dark ride experiences to guests 14 in a relatively compact space. The arrangements of dark ride tower system complexes 62, 64, 66 illustrated in FIGS. 24 through 27 further these advantages by facilitating the relatively close proximity of a plurality of dark ride tower systems 10.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. A dark ride tower system for an amusement park, comprising:

a tower comprising first and second levels, the first level comprising a stationary room having stationary walls and the second level comprising an adaptable room having adaptable walls configured to be rearranged into a plurality of physical configurations;

a ride vehicle configured to carry one or more guests of the amusement park;

a lift system configured to alternatingly move the ride vehicle between the first and second levels;

a first projection system configured to generate projection mapping on the stationary walls to simulate movement of the ride vehicle relative to the stationary room while the ride vehicle is disposed within the stationary room;

a second projection system configured to generate projection mapping on the adaptable walls to present a show scene while the ride vehicle is disposed within the adaptable room; and a controller configured to synchronize movement of the ride vehicle caused by the lift system, rearrangement of the adaptable walls, and generation of the projection mapping on the stationary and adaptable walls via the first and second projection systems.

2. The dark ride tower system of claim 1, wherein the lift system is configured to translate and rotate the ride vehicle relative to an imaginary central axis of the lift system.

3. The dark ride tower system of claim 2, wherein the lift system is configured to move the ride vehicle with multiple degrees of freedom relative to the imaginary central axis of the lift system.

4. The dark ride tower system of claim 1, wherein the lift system is configured to pitch, roll, and/or heave the ride vehicle while the first projection system generates the projection mapping on the stationary walls to simulate horizontal and/or lateral movement of the ride vehicle.

5. The dark ride tower system of claim 1, wherein the controller is configured to actuate the adaptable walls to rearrange from a first physical configuration to a second physical configuration while the ride vehicle is disposed within the stationary room.

6. The dark ride tower system of claim 1, wherein the controller is configured to actuate the adaptable walls of the adaptable room to align vertically with the stationary walls of the stationary room to create a fully enclosed tower.

7. The dark ride tower system of claim 6, wherein the first and second projection systems are configured to generate synchronized projection mapping on both the adaptable walls and the stationary walls while the adaptable walls and the stationary walls are vertically aligned to simulate a gravity drop visually.

8. The dark ride tower system of claim 7, wherein the lift system is configured to drop the ride vehicle to simulate the gravity drop physically.

9. The dark ride tower system of claim 1, comprising one or more additional physical scene elements disposed within the adaptable room while the ride vehicle is disposed within the adaptable room.

10. The dark ride tower system of claim 1, wherein the second level is disposed above the first level in the tower.

11. The dark ride tower system of claim 1, wherein the second level is disposed below the first level in the tower.

12. The dark ride tower system of claim 1, wherein the lift system comprises a suspension lift system or a ground lift system.

13. The dark ride tower system of claim 1, wherein the dark ride tower system is one of a plurality of dark ride tower systems of a dark ride tower system complex.

14. A method, comprising:

using a lift system to alternatingly move a ride vehicle between a first level comprising a stationary room having stationary walls and a second level comprising an adaptable room having adaptable walls configured to be rearranged into a plurality of physical configurations;

generating projection mapping, via a first projection system, on the stationary walls to simulate movement of the ride vehicle relative to the stationary room while the ride vehicle is disposed within the stationary room;

actuating the adaptable walls to rearrange from a first physical configuration to a second physical configuration while the ride vehicle is disposed within the stationary room; and generating projection mapping, via a second projection system, on the adaptable walls to present a show scene while the ride vehicle is disposed within the adaptable room.

15. The method of claim 14, comprising using the lift system to pitch, roll, and/or heave the ride vehicle while the first projection system generates the projection mapping on the stationary walls to simulate horizontal and/or lateral movement of the ride vehicle.

16. The method of claim 14, comprising actuating the adaptable walls of the adaptable room to align vertically with the stationary walls of the stationary room to create a fully enclosed tower.

17. The method of claim 16, comprising generating, via the first and second projection systems, synchronized projection mapping on both the adaptable walls and the stationary walls while the adaptable walls and the stationary walls are vertically aligned to simulate a gravity drop visually.

18. The method of claim 17, comprising using the lift system to drop the ride vehicle to simulate the gravity drop physically.

19. A dark ride system for an amusement park, comprising:

a stationary room having stationary walls;

an adaptable room having adaptable walls configured to be rearranged into a plurality of physical configurations;

a ride vehicle configured to carry one or more guests of the amusement park;

a lift system configured to alternatingly move the ride vehicle between the stationary and adaptable rooms;

a first projection system configured to generate projection mapping on the stationary walls to simulate movement of the ride vehicle relative to the stationary room while the ride vehicle is disposed within the stationary room;

a second projection system configured to generate projection mapping on the adaptable walls to present a show scene while the ride vehicle is disposed within the adaptable room; and a controller configured to synchronize movement of the ride vehicle caused by the lift system, rearrangement of the adaptable walls, and generation of the projection mapping on the stationary and adaptable walls via the first and second projection systems.

20. The dark ride system of claim 19, wherein the controller is configured to actuate the adaptable walls to rearrange from a first physical configuration to a second physical configuration while the ride vehicle is disposed within the stationary room.

* * * * *